US007834823B2

(12) United States Patent
Uchino et al.

(10) Patent No.: US 7,834,823 B2
(45) **Date of Patent: *Nov. 16, 2010**

(54) DISPLAY APPARATUS, DRIVING METHOD THEREOF AND ELECTRONIC DEVICE

(75) Inventors: Katsuhide Uchino, Tokyo (JP); Junichi Yamashita, Tokyo (JP); Naobumi Toyomura, Kanagawa (JP); Hideo Kataoka, Kanagawa (JP)

(73) Assignee: Sony Corporation, Tokyo (JP)

( * ) Notice: Subject to any disclaimer, the term of this patent is extended or adjusted under 35 U.S.C. 154(b) by 674 days.

This patent is subject to a terminal disclaimer.

(21) Appl. No.: 11/826,256

(22) Filed: Jul. 13, 2007

(65) Prior Publication Data

US 2008/0018629 A1 Jan. 24, 2008

(30) Foreign Application Priority Data

Jul. 19, 2006 (JP) ..... 2006-196875

(51) Int. Cl.
*G09G 3/30* (2006.01)

(52) U.S. Cl. ..... 345/76; 345/89; 345/90; 345/94; 345/204; 315/169.1; 315/169.3

(58) Field of Classification Search ..... 345/39, 345/44–46, 76–84, 204–214, 690–693, 88–94; 315/169.1–169.3
See application file for complete search history.

(56) References Cited

U.S. PATENT DOCUMENTS 7,173,590 B2 * 2/2007 Uchino et al. ..... 345/92
7,535,442 B2 * 5/2009 Yamashita et al. ..... 345/76
7,646,363 B2 * 1/2010 Yamashita et al. ..... 345/76
7,659,872 B2 * 2/2010 Yamashita et al. ..... 345/80

FOREIGN PATENT DOCUMENTS

| | | |
|---|---|---|
| JP | 2003-255856 | 9/2003 |
| JP | 2003-271095 | 9/2003 |
| JP | 2004-029791 | 1/2004 |
| JP | 2004-093682 | 3/2004 |
| JP | 2004-133240 | 4/2004 |

* cited by examiner

*Primary Examiner*—Lun-Yi Lao
*Assistant Examiner*—Jennifer T Nguyen
(74) *Attorney, Agent, or Firm*—Rader, Fishman & Grauer PLLC

(57) ABSTRACT

A display apparatus, comprising a pixel array section and a drive section that drives the pixel array section, wherein the pixel array section includes first scanning lines and second scanning lines arranged in rows, signals lines arranged in columns, pixels that are provided where the first scanning lines, the second scanning lines, and the signal lines meet and that are arranged in rows and columns, a power line that supplies power to each of the pixels, and an earth line. The drive section includes a first scanner that sequentially line scans the pixels in rows by sequentially supplying a first control signal to each of the first scanning lines, a second scanner that sequentially supplies a second control signal to each of the second scanning lines in conjunction with the sequential line scanning, and a signal selector that supplies a video signal to the columns of signal lines in conjunction with the sequential line scanning.

9 Claims, 17 Drawing Sheets

$$I_{ds} = k\mu\,(V_{gs}-V_{th})^2 = k\mu\,(V_{sig}-\Delta V)^2$$

DISPLAY APPARATUS, DRIVING METHOD THEREOF AND ELECTRONIC DEVICE

BACKGROUND OF THE INVENTION

1. Field of the Invention

The present invention relates to a display apparatus, as well as a driving method thereof, that displays images by driving light emitting elements arranged by pixels by an electric current. More specifically, the present invention relates to a display apparatus, as well as a driving method thereof, of the so-called active matrix type in which the amount of current that is passed through a light emitting element, such as an organic EL element and the like, is controlled by an insulated gate field effect transistor that is provided in each pixel circuit.

2. Description of Related Art

In image displaying apparatuses, such as liquid crystal displays, for example, numerous liquid crystal pixels are arranged in a matrix, and an image is displayed by controlling the transmission intensity or reflection intensity with respect to the incident light for each pixel in accordance with the image information for the image to be displayed. The same principle applies to an organic EL display that uses organic EL elements for its pixels, but unlike liquid crystal pixels, organic EL elements emit light themselves. As a result, organic EL displays offer such advantages over liquid crystal displays as better visibility, faster response speed, not requiring a backlight, and so forth. In addition, the brightness level (scale) of each light emitting element is controllable by way of the value of the current that flows therethrough, and thus differ from liquid crystal displays, which are controlled by voltage, in that they are controlled by current.

With organic EL displays, as same with liquid crystal displays, there is the simple matrix method and the active matrix method with respect to their driving methods. While the former has a simple structure, it has an issue in that application to large and high definition displays is difficult. As a result, development of the active matrix method is currently being actively pursued. This method is one in which the current that flows to the light emitting element within each pixel circuit is controlled by an active element (generally, a thin film transistor (TFT)) that is provided within the pixel circuit, and descriptions thereof can be found in the following patent documents.

[Patent Document 1] Japanese Patent Application Publication No. JP 2003-255856

[Patent Document 2] Japanese Patent Application Publication No. JP 2003-271095

[Patent Document 3] Japanese Patent Application Publication No. JP 2004-133240

[Patent Document 4] Japanese Patent Application Publication No. JP 2004-029791

[Patent Document 5] Japanese Patent Application Publication No. JP 2004-093682

SUMMARY OF THE INVENTION

A related art pixel circuit is provided at a position where a row of a scanning line that supplies control signals and a column of a signal line that supplies video signals cross, and includes at least a sampling transistor, a pixel capacitance, a drive transistor, and a light emitting element. The sampling transistor becomes conductive in accordance with the control signal supplied by the scanning line, and samples the video signal supplied by the signal line. The pixel capacitance holds an input voltage corresponding to the signal potential of the video signal that has been sampled. The drive transistor supplies an output current as a drive current during a predetermined light emitting period in accordance with the input voltage held by the pixel capacitance. It is noted that, in general, the output current is dependent on the carrier mobility of the channel region of and the threshold voltage of the drive transistor. The light emitting element emits light at a brightness corresponding to the video signal by means of the output current that is supplied by the drive transistor.

The drive transistor receives the input voltage held by the pixel capacitance at its gate and allows an output current to flow across its source and drain, thereby allowing a current to flow to the light emitting element. In general, the light emitting brightness of the light emitting element is proportional to the current applied. Further, the amount of the output current supplied by the drive transistor is controlled by the gate voltage, in other words the input voltage written in the pixel capacitance. In a conventional pixel circuit, the amount of current that is supplied to the light emitting element is controlled by varying the input voltage applied to the gate of the drive transistor in accordance with the input video signal.

The operating characteristics of the drive transistor can be expressed by Equation 1 below:

$$Ids=(1/2)\mu(W/L)\mathrm{Cox}(Vgs-Vth)^2 \qquad \text{Equation 1}$$

In Equation 1, Ids represents the drain current that flows across the source and the drain, and in the pixel circuit, it is the output current that is supplied to the light emitting element. Vgs represents the gate voltage that is applied to the gate with the source as a reference, and in the pixel circuit, it is the above-mentioned input voltage. Vth is the threshold voltage of the transistor. In addition, μ represents the mobility of the semiconductor thin film that makes up the channel of the transistor. W represents the channel width, L represents the channel length, and Cox represents the gate capacitance. As is apparent from Equation 1, when the thin film transistor operates in the saturation region, as the gate voltage Vgs increases in excess of the threshold voltage Vth, it enters an ON state and the drain current Ids flows through. In principle, as is indicated by Equation 1, so long as the gate voltage Vgs is uniform, a constantly same amount of drain current Ids is supplied to the light emitting element. Therefore, if a video signal of the same level is supplied to all of the pixels making up a screen, all pixels should emit light with the same brightness, and uniformity of the screen should be obtained.

However, in practice, thin film transistors (TFTs) that include a semiconductor thin film of, such as polysilicon and the like vary in their individual device characteristics. In particular, the threshold voltage Vth is not uniform, and varies from pixel to pixel. As can be seen from Equation 1 above, when the threshold voltage Vth of each drive transistor varies, the drain current Ids will vary even if the gate voltage Vgs is uniform, causing the brightness to vary from pixel to pixel, and uniformity of the screen is thus compromised. Pixel circuits with built-in functions for cancelling variations in the threshold voltage of drive transistors have been developed conventionally and are disclosed in, for example, Patent Document 3 mentioned above.

However, what causes the output current supplied to the light emitting element to vary is not just the threshold voltage Vth of the drive transistor. As is apparent from Equation 1 above, when the mobility μ of the drive transistor varies, the output current Ids varies. As a result, uniformity of the screen is compromised. Correcting for variations in mobility is also an issue to be resolved.

In view of the issues described above that are associated with conventional technology, the present invention seeks to provide a display apparatus, as well as a driving method thereof, in which a drive transistor mobility correction function is incorporated into each of its pixels. In particular, the present invention seeks to provide a display apparatus, as well as a driving method thereof, in which mobility correction can be performed adaptively in accordance with the brightness level of the pixel. In the present invention, the following measures are taken. More specifically, a display apparatus according to an embodiment of the present invention includes a pixel array section and a drive section that drives the pixel array section. The above-mentioned pixel array section may include rows of first scanning lines and second scanning lines, columns of signal lines, rows and columns of pixels provided where the above-mentioned first and second scanning lines and signal lines cross, a power line that provides power to each of the pixels, and an earth line. The above-mentioned drive section may include a first scanner that sequentially supplies a first control signal to each of the first scanning lines and that sequentially line scans the pixels row by row, a second scanner that sequentially supplies a second control signal to each of the second scanning lines in accordance with the above-mentioned sequential line scanning, and a signal selector that supplies video signals to the columns of signal lines in accordance with the above-mentioned sequential line scanning. Each of the above-mentioned pixels may include a light emitting element, a sampling transistor, a drive transistor, a switching transistor, and a pixel capacitance. With respect to the above-mentioned sampling transistor, its gate is connected to the above-mentioned first scanning line, its source is connected to the above-mentioned signal line, and its drain is connected to the gate of the above-mentioned drive transistor. The above-mentioned drive transistor and the above-mentioned light emitting element are connected in series between the above-mentioned power line and the above-mentioned earth line to form a current path. The above-mentioned switching transistor is inserted in the above-mentioned current path, and its gate is connected to the above-mentioned second scanning line. The above-mentioned pixel capacitance is connected between the source and the gate of the drive transistor. The above-mentioned sampling transistor turns on in accordance with the first control signal that is supplied from the first scanning line, samples the signal potential of the video signal supplied from the signal line and holds it in the above-mentioned pixel capacitance. The above-mentioned switching transistor turns on in accordance with the second control signal supplied from the above-mentioned second scanning line to place the above-mentioned current path in a conductive state. The above-mentioned drive transistor, in accordance with the signal potential held by the above-mentioned pixel capacitance, passes a drive current through the above-mentioned light emitting element via the above-mentioned current path that is placed in a conductive state. After applying the above-mentioned first control signal to the above-mentioned first scanning line to turn on the above-mentioned sampling transistor and starting the sampling of the signal potential, the above-mentioned drive section corrects the above-mentioned signal potential held by the above-mentioned pixel capacitance in accordance with the mobility of the above-mentioned drive transistor during a correction period, which is between a first timing at which the switching transistor turns on when the above-mentioned second control signal is applied to the above-mentioned second scanning line and a second timing at which the above-mentioned sampling transistor turns off when the above-mentioned first control signal applied to the first scanning line is terminated. In so doing, what is characteristic is that when the above-mentioned sampling transistor is turned off at the second timing, the above-mentioned first scanner gives a gradient to the trailing waveform of the above-mentioned first control signal. As a result, the above-mentioned second timing is automatically adjusted in such a manner that the above-mentioned correction period is made shorter when the signal potential is high, while the above-mentioned correction period is made longer when the signal potential is low. In addition, a plurality of trailing waveforms are selectively used in accordance with the level of the threshold voltage of the above-mentioned sampling transistor.

When the threshold voltage of the above-mentioned sampling transistor is a standard level, a standard trailing waveform may be used, where the gradient is initially steep down to a first potential and the gradient is then made gentle towards a second potential. When the threshold voltage of the above-mentioned sampling transistor is lower than the standard level, a trailing waveform may be used where the first potential and the second potential are both lower than the standard trailing waveform. When the threshold voltage of the above-mentioned sampling transistor is higher than the standard level, a trailing waveform may be used where only the second potential is higher than the standard trailing waveform. Each pixel may include an additional switching transistor that resets the gate potential and source potential of the above-mentioned drive transistor prior to the sampling of the video signals. The above-mentioned second scanner may temporarily turn on the above-mentioned switching transistor via the above-mentioned second scanning lines prior to the sampling of the video signals. By applying a drive current to the above-mentioned drive transistor that is thus reset, a voltage corresponding to the threshold voltage thereof is held by the above-mentioned pixel capacitance.

According to the present invention, utilizing part of a period in which the signal potential is sampled to the pixel capacitance (sampling period), the mobility of the drive transistor is corrected. More specifically, in the latter part of the sampling period, the switching transistor is turned on to put the current path in a conductive state, and a drive current is applied to the drive transistor. This drive current has a magnitude corresponding to the sampled signal potential. At this stage, the light emitting element is in a reverse bias state, the drive current does not flow through the light emitting element and is charged to the parasitic capacitance thereof or the pixel capacitance. Then, the sampling pulse falls, and the gate of the drive transistor is cut off from the signal lines. During the correction period from when the switching transistor turns on up to when the sampling transistor turns off, the drive current is negatively fed back to the pixel capacitance from the drive transistor, and an amount corresponding thereto is subtracted from the signal potential sampled to the pixel capacitance. Since this negative fed back amount works in a suppressive direction with respect to variations in the mobility of the drive transistor, mobility can be corrected for each pixel. In other words, when the mobility of the drive transistor is large, the amount of negative feedback with respect to the pixel capacitance becomes greater, the signal potential held by the pixel capacitance is greatly reduced, and the output current of the drive transistor is suppressed as a result. On the other hand, when the mobility of the drive transistor is small, the amount of negative feedback is also small, and the signal potential held by the pixel capacitance is not affected as much. Therefore, the output current of the drive transistor does not decrease as much. Here, the amount of negative feedback is at a level that corresponds to the signal potential that is directly applied to the gate of the drive transistor from the signal lines. In other words, as the signal potential becomes higher and the brightness greater, the amount of negative feedback becomes greater. Thus, mobility correction is performed in accordance with the brightness level.

However, the optimum corrective period is not necessarily the same between a case where brightness is high and a case where brightness is low. Generally, the optimum corrective period is relatively short when brightness is at a high level (white level). On the contrary, when brightness is at a medium level (gray level), the optimum corrective period tends to become longer. The present invention automatically optimizes the correction period in accordance with the brightness level. In other words, with the present invention, the second timing at which the sampling transistor turns off is, in relation to the first timing at which the switching transistor turns on, automatically adjusted in accordance with the signal potential. More specifically, an adaptive control is exercised such that the correction period becomes shorter when the signal potential of the video signal supplied from the signal line is high, while the correction period becomes longer when the signal potential of the video signal supplied from the signal line is low. More specifically, by giving a gradient to the trailing end of the control signal when the sampling transistor is turned off, it becomes possible to automatically set optimum mobility correction times for all scales, and uniformity of the screen can thus be improved drastically.

Even if it is possible to correct for the threshold voltage or mobility of the drive transistor, variations in the characteristics of the sampling transistor may sometimes affect image quality. In TFT processes where thin film transistors are integrated and formed for each pixel, it is not necessarily the case that transistors of identical characteristics would be integrated and formed in every stream lot. Depending on the time of manufacture or the condition of the manufacturing equipment, such characteristics as the threshold voltage of the sampling transistor may deviate from standard values. When the characteristics of the sampling transistor vary, even if the above-mentioned trailing waveforms of the control signal are used, the optimum correction period may vary, thereby causing the occurrence of uneven streaks in the displayed image, and hindering yield of a panel. As such, with the present invention, a plurality of trailing waveforms are selectively used in accordance with each level of the threshold voltage of the sampling transistor. When the threshold voltage of the sampling transistor deviates above or below a standard value, by selecting a trailing waveform in accordance with the level thereof, it becomes possible to automatically optimize the mobility correction period. For example, even a panel that is deemed defective because uneven streaks occur with standard waveforms can be converted into an acceptable product by selecting a different trailing waveform, and yield can thus be improved.

DETAILED DESCRIPTION OF EMBODIMENTS

Figure 1:
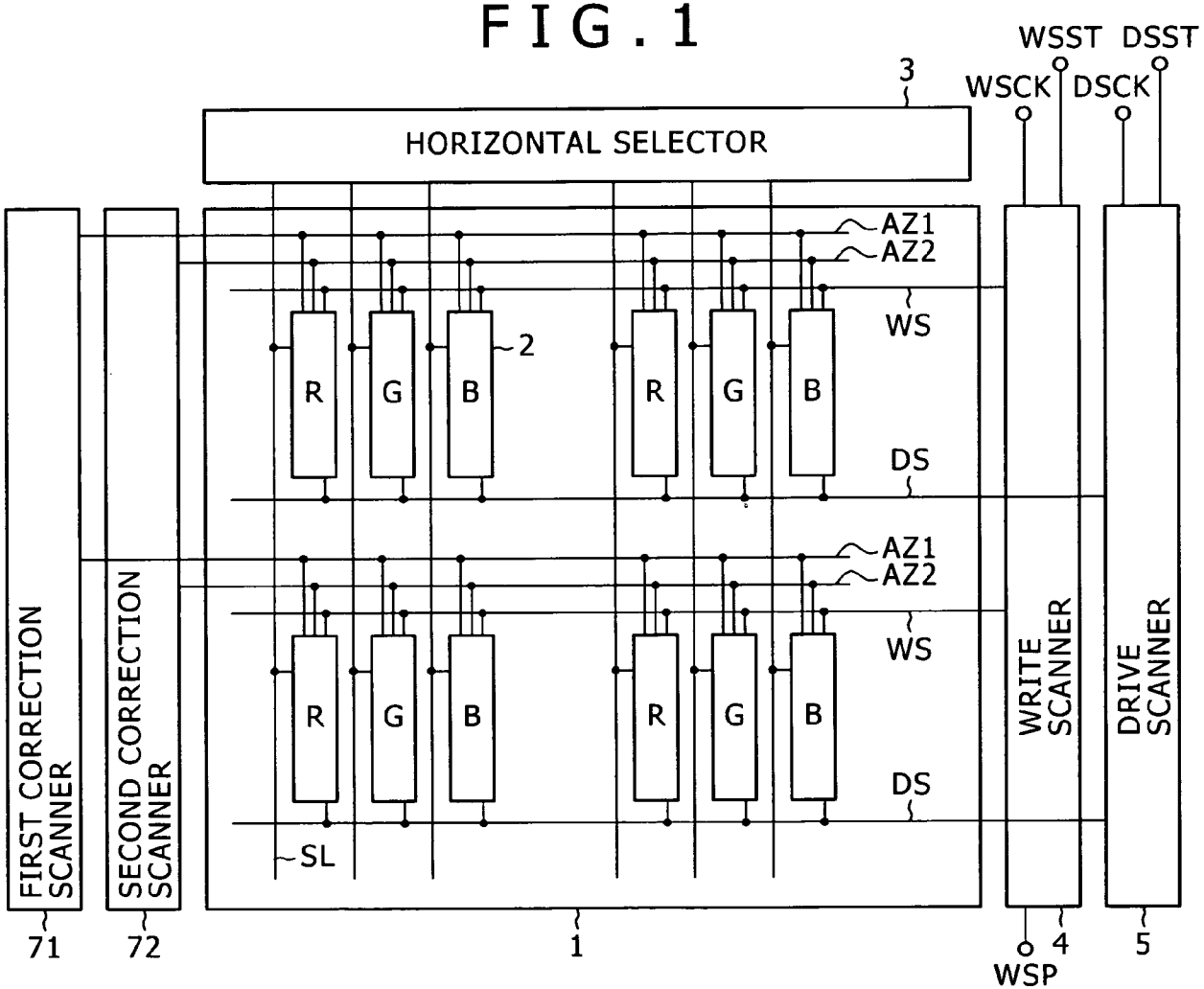
FIG. 1 is a schematic block diagram indicating main sections of a display apparatus according to an embodiment of the present invention.

Embodiments of the present invention are described in detail with reference to the drawings. FIG. 1 is a schematic block diagram indicating the overall configuration of a display apparatus according to an embodiment of the present invention. As shown in this diagram, the image display apparatus basically includes a pixel array section 1, and a drive section that includes a scanner section and a signal section. The pixel array section 1 includes scanning lines WS, AZ1, AZ2 and DS that are arranged in rows, signal lines SL that are arranged in columns, and pixel circuits 2, which are connected to these scanning lines WS, AZ1, AZ2 and DS and the signal lines SL and which are arranged in rows and columns, and a plurality of power lines which supply a first potential Vss1, a second potential Vss2, and a third potential Vcc which are necessary for operation of each of the pixel circuits 2. The signal section includes a horizontal selector 3, and supplies video signals to the signal lines SL. The scanner section includes a light scanner 4, a drive scanner 5, a first correction scanner 71 and a second correction scanner 72, and they supply control signals to the scanning lines WS, DS, AZ1 and AZ2, respectively, and sequentially scan the pixel circuits row by row.

The light scanner 4 includes shift registers, operates in accordance with a clock signal WSCK that is supplied from outside, sequentially forwards a start signal WSST that is similarly supplied from outside, and outputs it to each of the scanning lines WS. In so doing, a trailing waveform for the control signal WS is generated using a power source pulse WSP that is similarly supplied from outside. The drive scanner 5 also includes a shift register, operates in accordance with a clock signal DSCK that is supplied from outside, and sequentially outputs the control signal DS to each of the scanning lines DS by sequentially forwarding a start signal DSST that is similarly supplied from outside.

Figure 2:
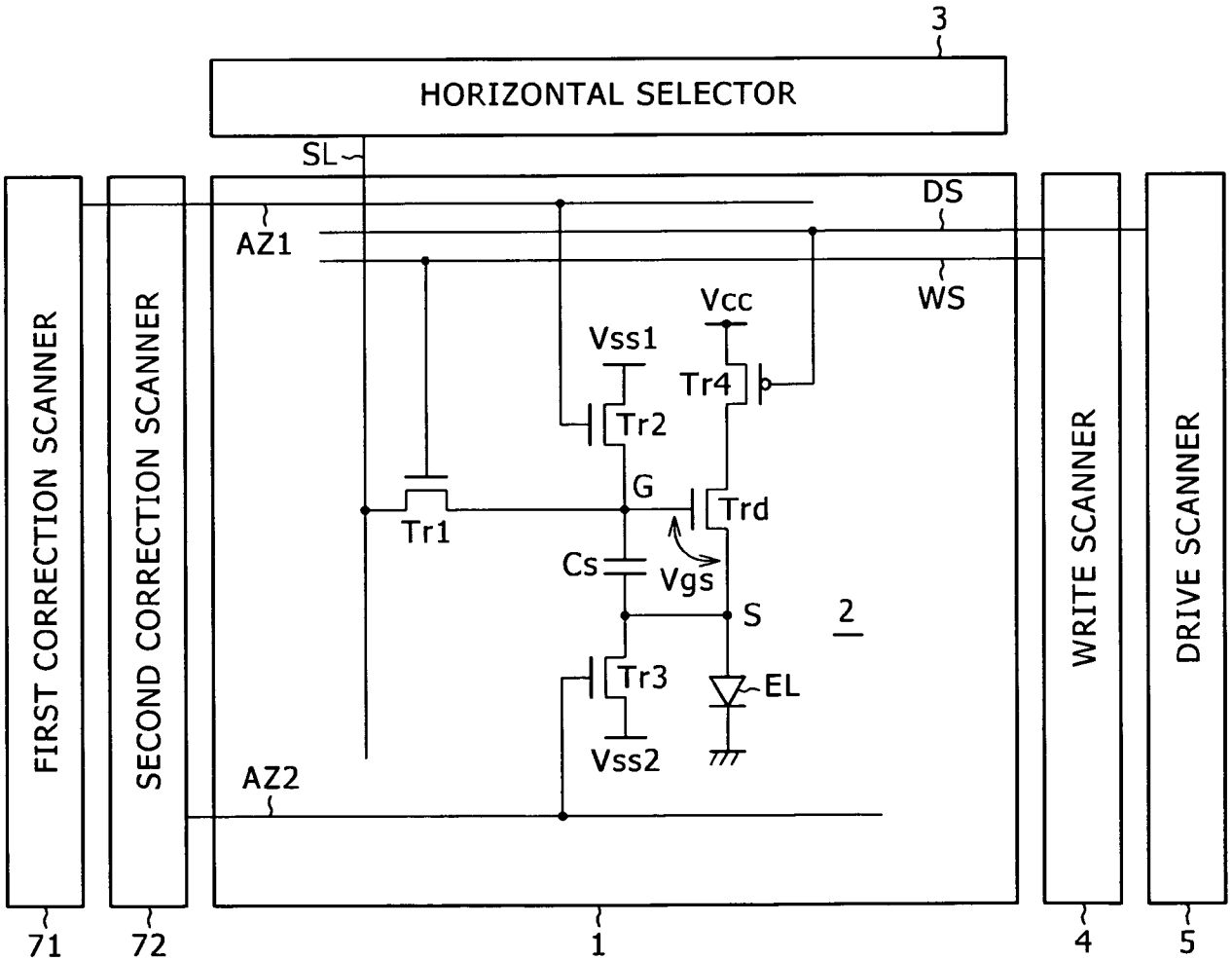
FIG. 2 is a circuit diagram indicating the pixel configuration of a display apparatus according to an embodiment of the present invention.

FIG. 2 is a circuit diagram indicating a configuration example of the pixel circuits incorporated in the image display apparatus shown in FIG. 1. As shown in the diagram, the pixel circuit 2 includes a sampling transistor Tr1, a drive transistor Trd, a first switching transistor Tr2, a second switching transistor Tr3, a third switching transistor Tr4, a pixel capacitance Cs, and a light emitting element EL. The sampling transistor Tr1 becomes conductive in accordance with a control signal supplied from the scanning line WS during a predetermined sampling period, and samples to the pixel capacitance Cs the signal potential of the video signal supplied from the signal line SL. The pixel capacitance Cs applies an input voltage Vgs to a gate G of the drive transistor Trd in accordance with the signal potential of the video signal that has been sampled. The drive transistor Trd supplies to the light emitting element EL an output current Ids corresponding to the input voltage Vgs. The light emitting element EL emits light at a brightness corresponding to the signal potential of the video signal by way of the output current Ids that is supplied from the drive transistor Trd during a predetermined light emitting period.

The first switching transistor Tr2 becomes conductive in accordance with a control signal that is supplied from the scanning line AZ1 prior to the sampling period, and sets the gate G of the drive transistor Trd to the first potential Vss1. The second switching transistor Tr3 becomes conductive in accordance with a control signal that is supplied from the scanning line AZ2 prior to the sampling period, and sets a source S of the drive transistor Trd to the second potential Vss2. The third switching transistor Tr4 becomes conductive in accordance with a control signal that is supplied from the scanning line DS prior to the sampling period, and connects the drive transistor Trd to the third potential Vcc, and thus corrects effects of a threshold voltage Vth by having a voltage corresponding to the threshold voltage Vth of the drive transistor be held by the pixel capacitance Cs. Further, this third switching transistor Tr4 becomes conductive in accordance with a control signal that is again supplied from the scanning line DS during the light emitting period, thereby connecting the drive transistor Trd to the third potential Vcc, and lets the output current Ids flow to the light emitting element EL.

As can be seen from the description above, the pixel circuit 2 includes the five transistors Tr1 to Tr4 and Trd, one pixel capacitance Cs, and one light emitting element EL. The transistors Tr1 to Tr3 and Trd are N-channel polysilicon TFTs. Only the transistor Tr4 is a P-channel polysilicon TFT. However, the present invention is not limited thereto, and it is possible to use an appropriate mix of N-channel TFTs and P-channel TFTs. The light emitting element EL is, for example, an organic EL device of a diode type that is equipped with an anode and a cathode. However, the present invention is not limited thereto, and the light emitting element here may include all devices in general that are driven by a current to emit light.

Figure 3:
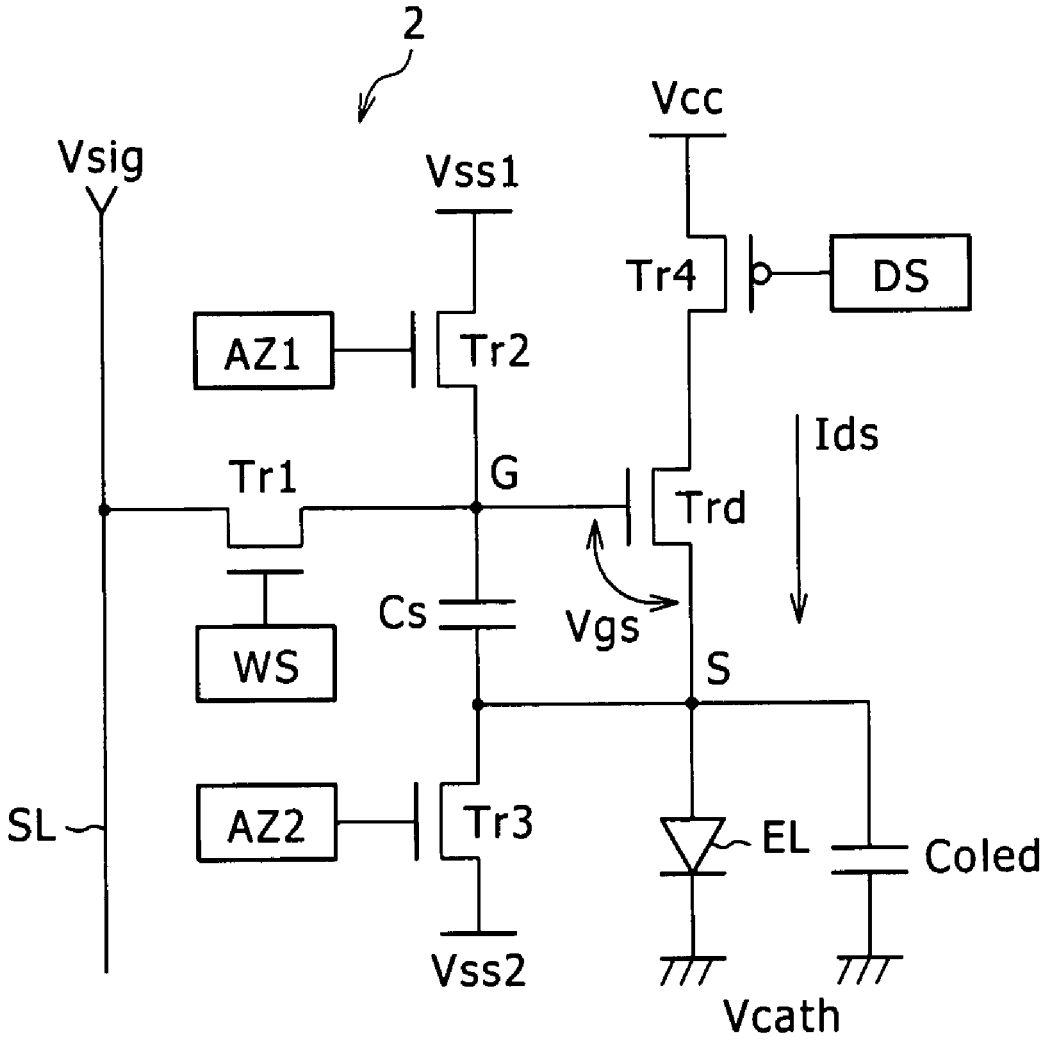
FIG. 3 is a schematic diagram that aids in explaining the operations of a display apparatus according to an embodiment of the present invention.

FIG. 3 is a schematic diagram in which only the pixel circuit 2 portion is taken out from the image display apparatus shown in FIG. 2. In order to facilitate easier understanding, a signal potential Vsig of the video signal sampled by the sampling transistor Tr1, the input voltage Vgs and the output current Ids of the drive transistor Trd, a capacitance component Coled that the light emitting element EL has, and the like are additionally written in. Operations of the pixel circuit 2 according to an embodiment of the present invention will be described based on FIG. 3.

Figure 4:
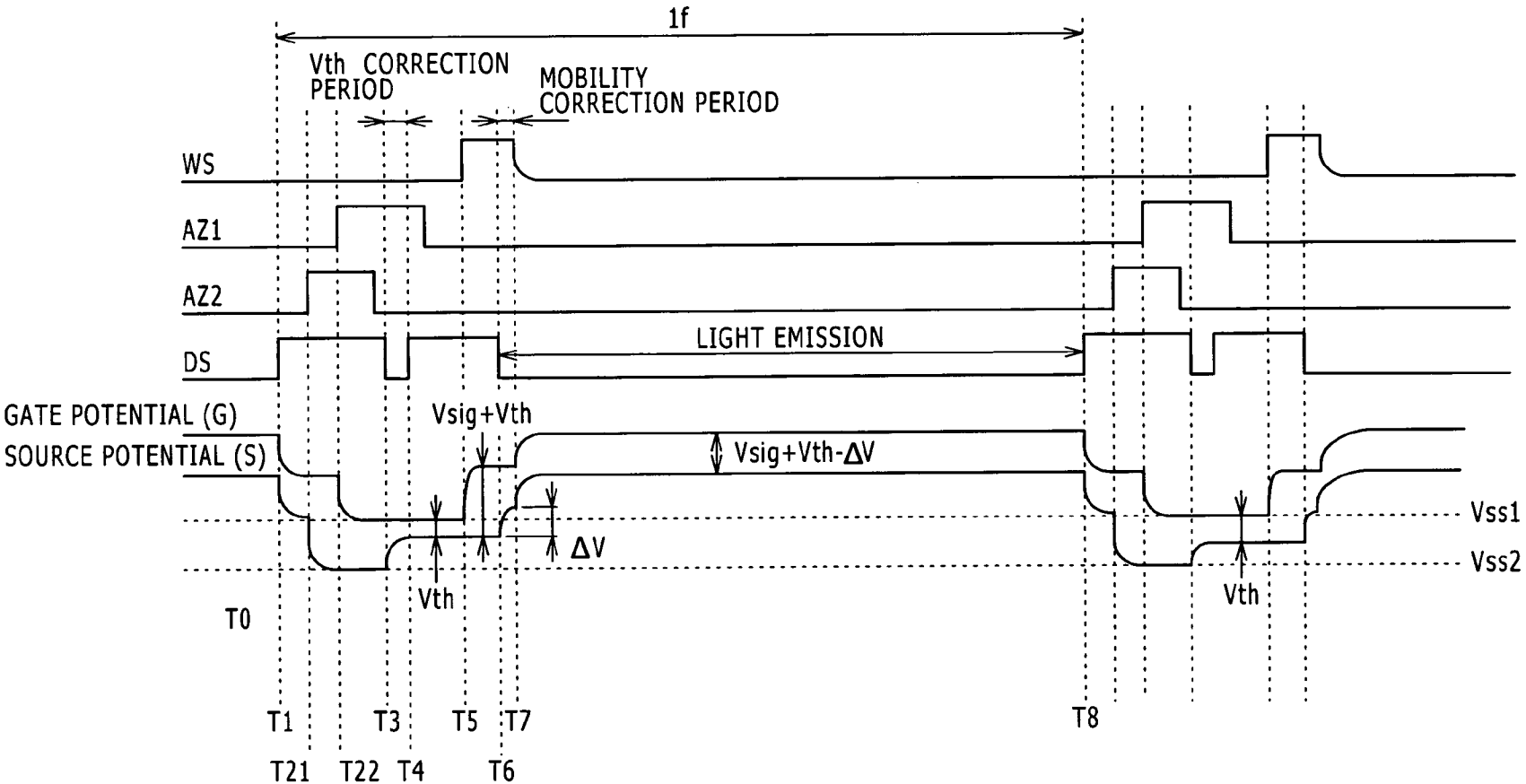
FIG. 4 is a timing chart that aids in explaining the operations of a display apparatus according to an embodiment of the present invention.

FIG. 4 is a timing chart of the pixel circuit shown in FIG. 3. With reference to FIG. 4, operations of the pixel circuit according to an embodiment of the present invention and shown in FIG. 3 will be described in detail. Along a time axis T, FIG. 4 indicates the waveforms of the control signals applied to each of the scanning lines WS, AZ1, AZ2 and DS. In order to simplify the representation, the control signals are indicated with the same reference symbols as those of the corresponding scanning lines. Since the transistors Tr1, Tr2, and Tr3 are of an N-channel type, they turn on when the scanning lines WS, AZ1, and AZ2, respectively, are at high levels, and turn off when they are at low levels. On the other hand, since the transistor Tr4 is a P-channel type, it turns off when the scanning line DS is at a high level and turns off when the scanning line DS is at a low level. It is noted that this timing chart shows, along with the waveforms of each of the control signals WS, AZ1, AZ2 and DS, changes in the potential of the gate G, as well as of the source S, of the drive transistor Trd.

For the timing chart in FIG. 4, timings T1 through T8 are taken to be one field (1f). During one field, each row of the pixel array is sequentially scanned once. This timing chart indicates the waveforms of each of the control signals WS, AZ1, AZ2 and DS that are applied to a row of pixels.

At timing T0 before the above-mentioned field begins, all of the above-mentioned control signals WS, AZ1, AZ2, and DS are at low levels. Therefore, while the N-channel transistors Tr1, Tr2, and Tr3 are in an off state, the P-channel transistor Tr4 alone is in an on state. Therefore, since the drive transistor Trd is connected with the power source Vcc via the transistor Tr4, which is in an on state, the drive transistor Trd supplies to the light emitting element EL the output current Ids in accordance with the predetermined input voltage Vgs. Thus, at timing T0, the light emitting element EL is emitting light. Here, the input voltage Vgs that is applied to the drive transistor Trd can be expressed by difference between the gate potential (G) and the source potential (S).

At timing T1 at which the field begins, the control signal Ds switches from a low level to a high level. As a result, the transistor Tr4 turns off, the drive transistor Trd is cut off from the power source Vcc, and the emission of light is terminated, and a non-light emitting period thus begins. Therefore, upon entering timing T1, all of the transistors Tr1 to Tr4 enter an off state.

Following timing T1, the control signal AZ2 rises at timing T21, and the switching transistor Tr3 turns on. As a result, the source potential (S) of the drive transistor Trd is initialized to the predetermined potential Vss2. Subsequently, at timing T22, the control signal AZ1 rises, and the switching transistor Tr2 turns on. As a result, the gate potential (G) of the drive transistor Trd is initialized to the predetermined potential Vss1. As a result, the gate G of the drive transistor Trd is connected to the reference potential Vss1, and the source S is connected with the reference potential Vss2. Here, the condition Vss1−Vss2>Vth is satisfied, and the Vth correction that is performed thereafter at timing T3 is prepared for by satisfying Vss1−Vss2=Vgs>Vth. In other words, the period between T21 and T3 corresponds to a resetting period for the drive transistor Trd. In addition, assuming that the threshold voltage of the light emitting element EL is VthEL, VthEL is set to be greater than Vss2. As a result, a negative bias is applied to the light emitting element EL, and the light emitting element EL is placed in a so-called reverse bias state. This reverse bias state is necessary in order to properly perform the Vth correction operation and mobility correction operation which is performed later on.

At timing T3, after the control signal AZ2 is lowered to a low level, the control signal Ds is lowered to a low level. Thus, the transistor Tr3 turns off, while the transistor Tr4 turns on. As a result, a drain current Ids flows into the pixel capacitance Cs, and the Vth correction operation is initiated. At this point, the gate G of the drive transistor Trd is held at Vss1, and the current Ids flows until the drive transistor Trd cuts off. Once the drive transistor Trd cuts off, the source potential (S) of the drive transistor Trd becomes Vss1−Vth. At timing T4, which is after the drain current is cut off, the control signal Ds is returned to a high level again, and the switching transistor Tr4 is turned off. Further, the control signal AZ1 is also returned to a low level, and the switching transistor Tr2 is turned off. As a result, Vth is held and fixed at the pixel capacitance Cs. As described above, timing T3-T4 is a period for detecting the threshold voltage Vth of the drive transistor Trd. Hereinafter, such detection period T3-T4 is referred to as the Vth correction period.

After the Vth correction is performed as described above, the control signal WS is switched to a high level at timing T5 to turn the sampling transistor Tr1 on, and the signal potential Vsig of the video signal is written in the pixel capacitance Cs. The pixel capacitance Cs is sufficiently small compared to an equivalent capacitance Coled of the light emitting element EL. As a result, a substantial majority of the signal potential Vsig of the video signal is written in the pixel capacitance Cs. More precisely, the difference of Vsig with reference to Vss1, which is Vsig−Vss1, is written in the pixel capacitance Cs. Therefore, the voltage Vgs across the gate G and the source S of the drive transistor Trd is at a level where Vth, which is detected and held in advance, and Vsig−Vss1, which is sampled as described directly above, are added together (in other words, Vsig−Vss1+Vth). For purposes of simple operation, if it is assumed that Vss1=0V, the voltage Vgs across the gate and the source is, as indicated in the timing chart in FIG. 4, Vsig+Vth. The sampling of the signal potential Vsig of the video signal is continued up to timing T7 at which the control signal WS returns to a low level. In other words, a timing T5-T7 corresponds to a sampling period.

At timing T6, which comes before timing T7 at which the sampling period terminates, the control signal Ds becomes a low level, and the switching transistor Tr4 turns on. Thus, the drive transistor Trd is connected to the power source Vcc, and the pixel circuit proceeds from a non-light emitting period to a light emitting period. During period T6-T7 in which the sampling transistor Tr1 is still in an ON state and in which the switching transistor Tr4 has entered an ON state as described above, the mobility correction for the drive transistor Trd is performed. In other words, with an embodiment of the present invention, mobility correction is performed during period T6-T7 in which the latter part of the sampling period and the beginning part of the light emitting period overlap. It is noted that in the beginning of the light emitting period during which mobility correction is performed, the light emitting element EL is in fact in a reverse bias state, and therefore does not emit light. During this mobility correction period T6-T7, the drain current Ids flows through the drive transistor Trd in a state where the gate G of the drive transistor Trd is fixed at the level of the signal potential Vsig of the video signal. Here, by setting Vss1−Vth to be less than VthEL in advance, the light emitting element EL is placed in a reverse bias state, and exhibits not diode characteristics, but simple capacitive characteristics. Thus, the current Ids that flows through the drive transistor Trd is written in a capacitance C=Cs+Coled, where the pixel capacitance Cs and the equivalent capacitance Coled of the light emitting element EL combined. As a result, the source potential (S) of the drive transistor Trd rises. In the timing chart in FIG. 4, this rise is expressed as ΔV. Since this rise ΔV is eventually subtracted from the voltage Vgs across the gate and the source that is held by the pixel capacitance Cs, it means a negative feedback is applied. By negatively feeding back the output current Ids of the drive transistor Trd to the input voltage Vgs of the drive transistor Trd as described above, it is possible to correct mobility μ. It is noted that by adjusting the timing width t of the mobility correction period T6-T7, the negative feedback amount ΔV can be optimized. Accordingly, a gradient is given to the trailing end of the control signal WS.

At timing T7, the control signal WS is at a low level, and the sampling transistor Tr1 turns off. As a result, the gate G of the drive transistor Trd is cut off from the signal line SL. Since the application of the signal potential Vsig of the video signal is terminated, the gate potential (G) of the drive transistor Trd is now able to rise, and rises along with the source potential (S). Meanwhile, the voltage Vgs across the gate and the source that is held by the pixel capacitance Cs maintains the value of (Vsig−ΔV+Vth). As the source potential (S) rises, the reverse bias state of the light emitting element EL is resolved, thereby allowing the output current Ids to flow in, and the light emitting element EL begins to actually emit light. The relationship between the drain current Ids and the gate voltage Vgs at this point can be expressed by Equation 2 below by substituting Vsig−ΔV+Vth for Vgs in equation 1 mentioned above.

$$Ids=k\mu(Vgs-Vth)2=k\mu(Vsig-\Delta V)^2 \qquad \text{Equation 2}$$

In Equation 2 above, k=(½)(W/L)Cox. From Equation 2, it can be seen that the term Vth is cancelled, and that the output current Ids supplied to the light emitting element EL is not dependent on the threshold voltage Vth of the drive transistor Trd. Basically, the drain current Ids is determined by the signal potential Vsig of the video signal. In other words, the light emitting element EL emits light at a brightness that corresponds to the signal potential Vsig of the video signal. In so doing, Vsig is corrected by the feedback amount ΔV. This correction amount ΔV works to just cancel out the effect of mobility μ which is positioned at the coefficient part in Equation 2. Therefore, the drain current Ids is in effect dependent only on the signal potential Vsig of the video signal.

Finally, at timing T8, the control signal DS becomes a high level, the switching transistor Tr4 turns off, and as the emission of light is terminated, the field comes to an end. Thereafter, the next field begins, and the Vth correction operation, the sampling operation for the signal potential, the mobility correction operation and the light emission operation are repeated.

Figure 5:
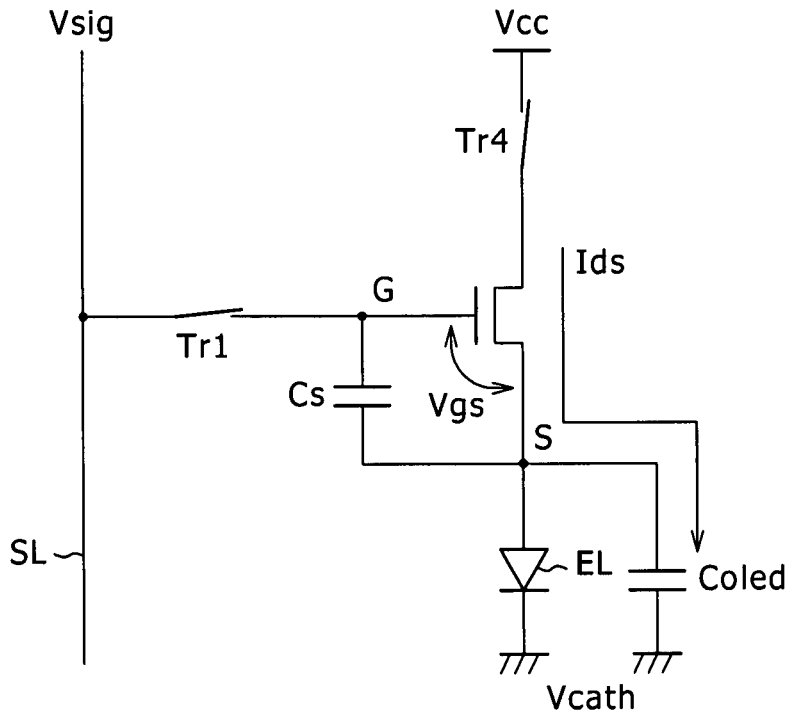
FIG. 5 is a schematic circuit diagram that aids in explaining the operations of a display apparatus according to an embodiment of the present invention.

FIG. 5 is a circuit diagram indicating the state of the pixel circuit 2 during the mobility correction period T6-T7. As shown in the diagram, during the mobility correction period T6-T7, while the sampling transistor Tr1 and the switching transistor Tr4 are in an ON state, remaining switching transistors Tr2 and Tr3 are in an OFF state. In this state, the source potential (S) of the drive transistor Tr4 is Vss1−Vth. This source potential (S) also happens to be the anode potential of the light emitting element EL. As described above, by setting Vss1−Vth to be smaller than VthEL in advance, the light emitting element EL is placed in a reverse bias state, and exhibits not diode characteristics but simple capacitive characteristics. Therefore, the current Ids that flows through the drive transistor Trd flows into a capacitance C=Cs+Coled, where the pixel capacitance Cs and the equivalent capacitance Coled of the light emitting element EL are combined. In other words, a portion of the drain current Ids is negatively fed back to the pixel capacitance Cs to correct mobility.

Figure 6:
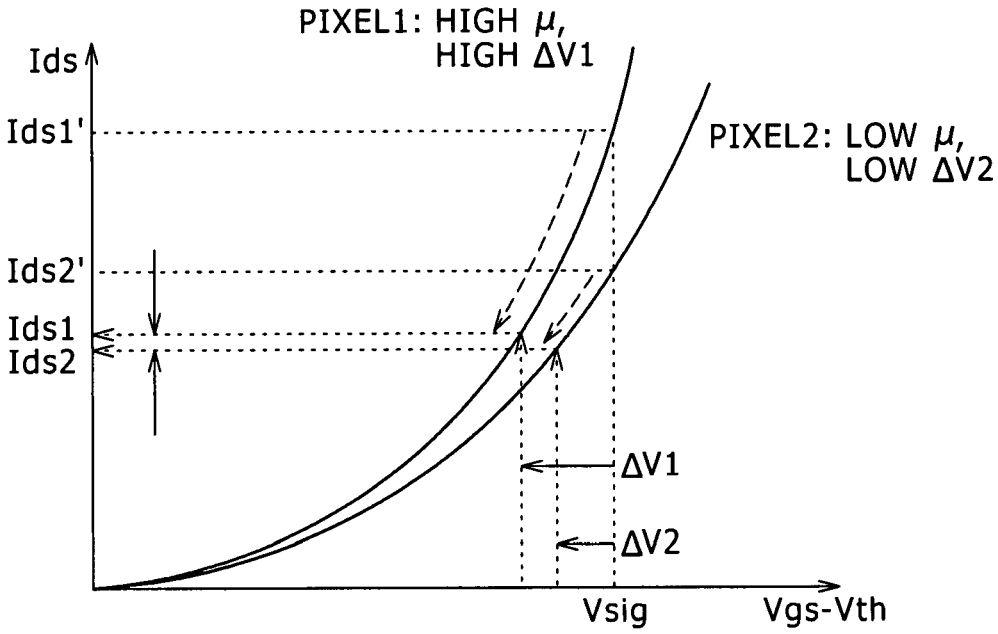
FIG. 6 is a graph that aids in explaining the operations of a display apparatus according to an embodiment of the present invention.

FIG. 6 is a diagram in which Equation 2 mentioned above is expressed as a graph, and the vertical axis represents Ids and the horizontal axis represents Vsig. Equation 2 is also indicated below the graph. The graph in FIG. 6 shows characteristic curves and compares pixel 1 and pixel 2. The mobility μ of the drive transistor of the pixel 1 is relatively large. On the contrary, the mobility μ of the drive transistor included in the pixel 2 is relatively small. When a polysilicon thin film transistor is used for the drive transistor as described above, it is inevitable that mobility μ would vary from pixel to pixel. For example, when the signal potential Vsig of video signals of the same level are written in both pixels 1 and 2, if no mobility correction is performed, there would arise a great difference between an output current Ids 1' that flows through the pixel 1, whose mobility μ is large, and an output current Ids 2' that flows through the pixel 2, whose mobility μ is small. Thus, since large differences between the output currents Ids occur as a result of variations in mobility μ, uneven streaks occur, and uniformity of the screen is compromised.

As such, with an embodiment of the present invention, variations in mobility are cancelled out by negatively feeding back the output current to the input voltage side. As is apparent from Equation 1, when mobility is large, the drain current Ids becomes greater. Therefore, the negative feedback amount ΔV is greater the greater the mobility is. As indicated in the graph in FIG. 6, a negative feedback amount ΔV1 of the pixel 1, whose mobility μ is large, is greater as compared to a negative feedback amount ΔV2 of the pixel 2, whose mobility is small. Thus, variations can be suppressed since the negative feedback becomes greater the greater the mobility μ is. As shown in the diagram, when a correction of ΔV1 is performed for the pixel 1, whose mobility μ is large, the output current drops significantly from Ids 1' to Ids 1. On the other hand, since the correction amount ΔV2 of the pixel 2, whose mobility μ is small, is small, the output current drops from Ids 2' to Ids 2 which is not as much. As a result, Ids 1 and Ids 2 become similar in value, and variations in mobility are cancelled out. Since this cancellation of variations in mobility is performed across the entire range of Vsig from the black level to the white level, uniformity of the screen becomes significantly high. Summing up the description above, when there are two pixels 1 and 2, whose mobilities are different, the correction amount ΔV1 of the pixel 1, whose mobility is large, becomes small in relation to the correction amount ΔV2 of the pixel 2, whose mobility is small. In other words, the greater the mobility is, the greater ΔV is, and thus the amount by which Ids decreases becomes greater. As a result, the current values for pixels with differing mobilities are equalized, and it thus becomes possible to correct variations in mobility.

Hereinafter, for reference, a numerical analysis of the above-mentioned mobility correction will be given. As shown in FIG. 5, an analysis will be performed with the transistors Tr1 and Tr4 in an on state, and with the source potential of the drive transistor Trd taken to be variable V. Assuming that the source potential (S) of the drive transistor Trd is V, the drain current Ids flowing through the drive transistor Trd is as expressed by Equation 3 below.

$$I_{ds}=k\mu(V_{gs}-V_{th})^2=k\mu(V_{sig}-V-V_{th})^2 \qquad \text{Equation 3}$$

In addition, based on the relationship between the drain current Ids and the capacitance C (=Cs+Coled), Ids=dQ/dt=CdV/dt holds true as indicated by Equation 4 below.

$$I_{ds}=\frac{dQ}{dt}=C\frac{dV}{dt} \qquad \text{Equation 4}$$

THEN $$\begin{aligned}\int\frac{1}{C}dt &= \int\frac{1}{I_{ds}}dV \Leftrightarrow \int_0^t\frac{1}{C}dt\\ &= \int_{-Vth}^{V}\frac{1}{k\mu(V_{sig}-V_{th}-V)^2}dV \Leftrightarrow \frac{k\mu}{C}t\\ &= \left[\frac{1}{V_{sig}-V_{th}-V}\right]_{-Vth}^{V}\\ &= \frac{1}{V_{sig}-V_{th}-V}-\frac{1}{V_{sig}} \Leftrightarrow V_{sig}-V_{th}-V\\ &= \frac{1}{\frac{1}{V_{sig}}+\frac{k\mu}{C}t}\\ &= \frac{V_{sig}}{1+V_{sig}\frac{k\mu}{C}t}\end{aligned}$$

Equation 3 is substituted into equation 4, and both sides are integrated. Here, the initial state of the source voltage V is −Vth, and the mobility variation correction time (T6-T7) is t. Solving this differential equation, the pixel current with respect to the mobility correction time t is given by Equation 5 below.

$$I_{ds}=k\mu\left(\frac{V_{sig}}{1+V_{sig}\frac{k\mu}{C}t}\right)^2 \qquad \text{Equation 5}$$

Figure 7:
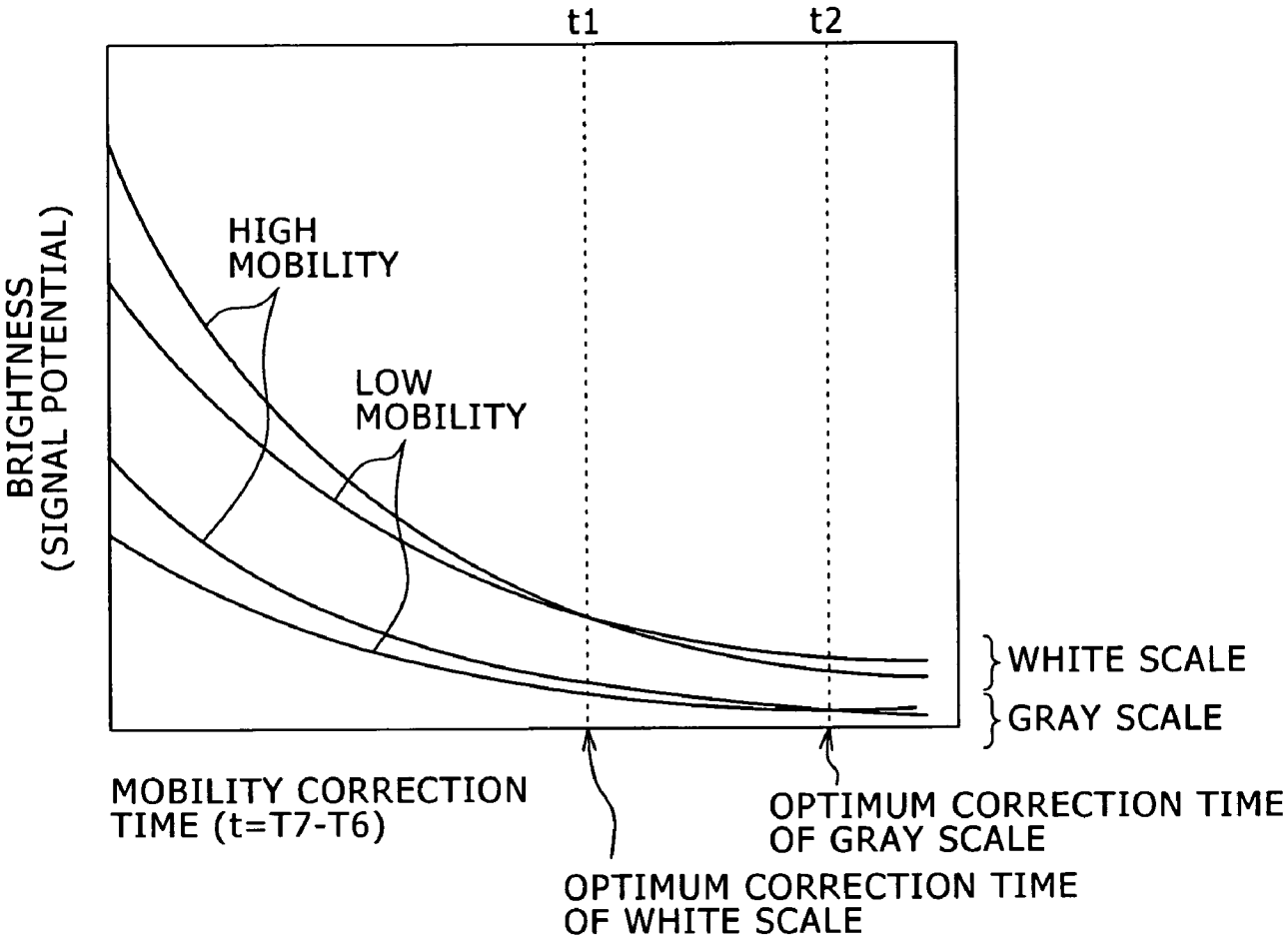
FIG. 7 is a graph that aids in explaining the operations of a display apparatus according to an embodiment of the present invention.

Meanwhile the optimum mobility correction time t tends to differ depending on the brightness level of the pixel (or the signal potential Vsig of the video signal). This point will be explained with reference to FIG. 7. In the graph in FIG. 7, the horizontal axis represents the mobility correction time t (T7-T6), and the vertical axis represents brightness (signal potential). At high brightness (white scale), the brightness level becomes comparable between a high mobility drive transistor and a low mobility drive transistor when the mobility correction time is at t1. In other words, when a scale of the input signal potential is white scale, the mobility correction time t1 is the optimum correction time. On the other hand, when the signal potential is at medium brightness (gray scale), there is a difference in brightness, at mobility correction time t1, between the high mobility transistor and the low mobility transistor, and perfect correction cannot be performed. When a correction time t2 that is longer than t1 is secured, the brightness level becomes comparable between the high mobility transistor and the low mobility transistor. Therefore, when scale of the signal potential is a gray scale, the optimum correction time t2 is longer than the optimum correction time t1 for white scales.

If the mobility correction time t is fixed regardless of the brightness level, it becomes impossible to perform mobility correction perfectly at all scales, and uneven streaks occur. For example, if the mobility correction time t is fixed at t1 which is the optimum correction time for white scales, streaks remain on the screen when the input video signal is a gray scale. On the contrary, if the mobility correction time is fixed at t2 which is the optimum correction time for gray scales, uneven streaks appear when the video signal is a white scale. In other words, if the mobility correction time t is fixed, variations in mobility cannot be corrected at once for across all scales ranging from white to gray.

Figure 8:
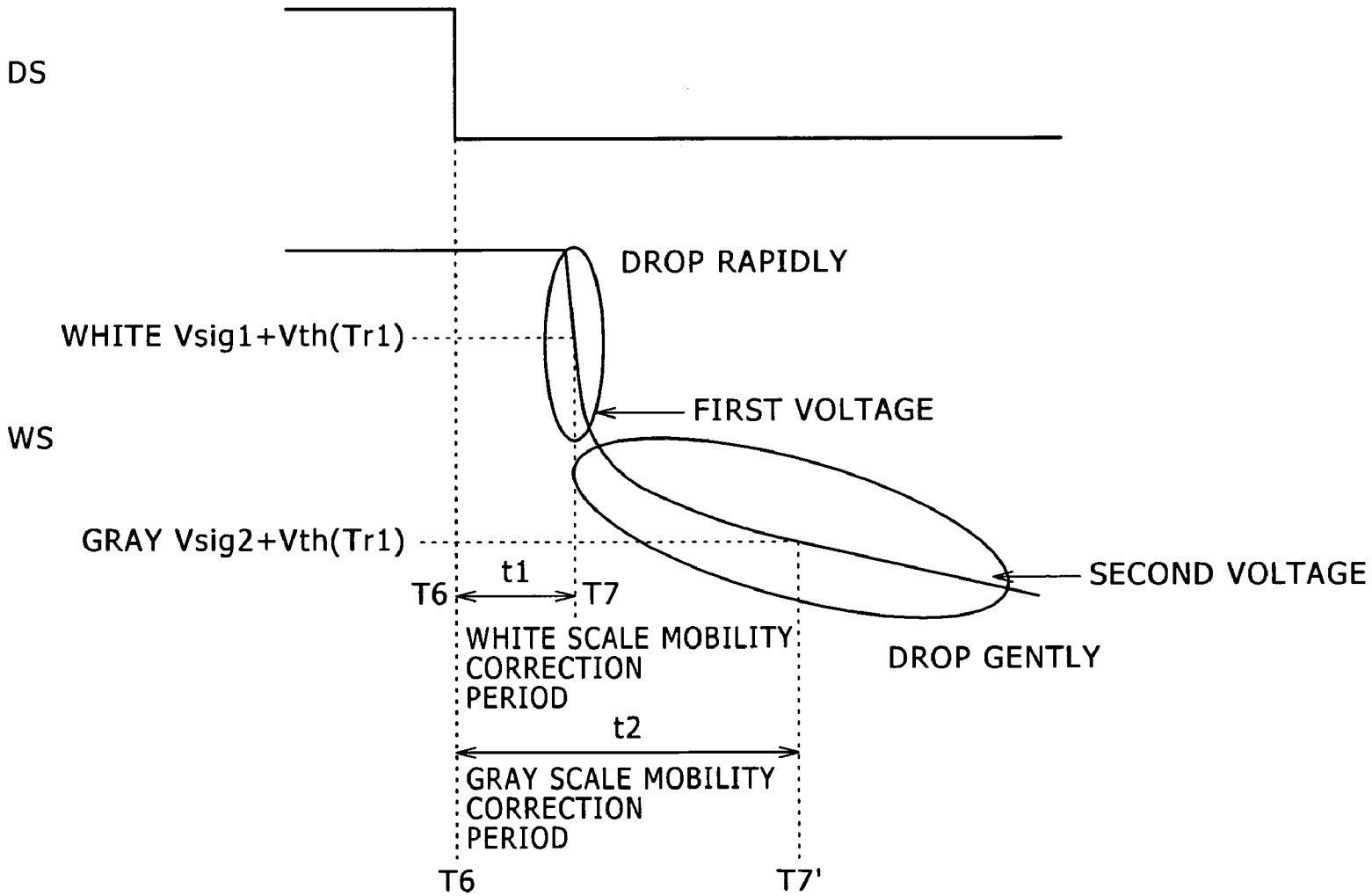
FIG. 8 is a waveform chart that aids in explaining the operations of a display apparatus according to an embodiment of the present invention.

As such, with the present embodiment, the mobility correction period is made automatically adjustable so as to be optimized in accordance with the level of the input video signal. This point will be described in detail with reference to FIG. 8. FIG. 8 indicates the trailing waveform of the control signal DS that is applied to the gate of the switching transistor Tr4. In the present embodiment, since the switching transistor Tr4 is of a P-channel type, the transistor Tr4 turns on at the point where the control signal DS falls (T6). As described above, this timing T6 is the point at which the mobility correction period begins. Along with the control signal DS, the trailing waveform of the control signal WS is also indicated. This control signal WS is applied to the gate of the sampling transistor Tr1. As described above, since the sampling transistor Tr1 is of an N-channel type in the present embodiment, the sampling transistor Tr1 turns off at timing T7 when the control signal WS falls, thereby terminating the mobility correction period.

With the present embodiment, in turning the waveform of the control signal WS off, the waveform is initially dropped rapidly to an appropriate potential, and the pulse is then dropped more slowly therefrom to a final potential. Thus, there can be provided two or more mobility correction periods with a certain scale, which is determined by some desired potential, as a boundary. For purposes of convenience, the first voltage to which the waveform is dropped rapidly will be referred to as the first voltage, whereas the final potential to which the waveform is dropped more slowly will be referred to as the second voltage. Here, as a model case, operations will be considered with respect to the waveform of the control signal WS where the first voltage is 8V and the second voltage is 4V. In addition, the threshold voltage of the sampling transistor Tr1 is assumed to be Vth (Tr1)=2V.

If white scale Vsig1=8V is written in, the sampling transistor Tr1 cuts off at timing T7 at which the control signal WS drops down to Vsig1+Vth (Tr1)=10V. In other words, when Vsig=8V is applied from the signal line to the source of the sampling transistor Tr1, the sampling transistor Tr1 cuts off at a point where the gate potential of the sampling transistor Tr1 is higher than the source potential by just the threshold voltage of 2V. Thus, in the case of white scales, the mobility correction period t1=T7-T6 is determined during the period between the on timing T6 for the control signal DS and timing T7 at which the control signal WS drops rapidly to the first voltage.

On the other hand, when gray scale Vsig2=4V is written in, the cut off voltage for the sampling transistor Tr1 becomes Vsig2+Vth (Tr1)=6V. The point at which the control signal WS reaches the cut off voltage of 6V is timing T7'. In the case of gray scales, the correction period t2 is defined as the period between the on timing T6 for the control signal DS and point T7' which is the period where the waveform of the control signal WS drops slowly from the first voltage at which it turns off to the second voltage. In other words, the correction period t2 for gray scales is longer than the correction time t1 for white scales.

For an even lower scale, for example where Vsig=3V, the cut off voltage for the sampling transistor Tr1 similarly becomes 5V, and since the trailing end of the waveform is made more moderate, the cut off timing T7' is shifted further back, and the mobility correction time becomes longer. Thus, in this driving method, the mobility correction time t is made longer as the scale becomes lower.

Thus, by setting timing T7 in accordance with the optimum correction time t1 for white scales from when the control signal DS turns on up to when the control signal WS is rapidly dropped to the first voltage upon turn off, the correction time for white scales is optimized. The first voltage should be set taking into account the threshold voltage Vth (Tr1) of the sampling transistor Tr1 so that the sampling transistor Tr1 would cut off reliably and at a rapid point for white scales. In addition, as for lower scales, they can be accommodated by finding the optimum correction time t2 for each scale, by setting the second voltage in accordance therewith, and by determining to what extent the trailing waveform of the control signal WS should be made more moderate. By thus automatically adjusting the optimum correction time t that matches all levels from high scale to low scale and cancelling out variations in mobility, it becomes possible to eliminate uneven streaks at all scales.

Through the driving method described above, it is basically possible to automatically adjust the optimum correction time at all scales, and the yield rate of panel inspection can be improved drastically. However, in TFT processes, it is not necessarily the case that transistors with identical characteristics would be formed in every stream lot, and transistor characteristics sometimes deviate from standard values depending on the time of manufacture or the condition of the manufacturing equipment. When transistor characteristics vary, a single trailing waveform would not guarantee an optimum correction period, and would thus cause defective products to increase. In order to improve such conditions, with the present embodiment, it is proposed that a plurality of trailing waveforms for the control signals be selectively used in accordance with variations in transistor characteristics. A main example of variations in sampling transistor characteristics that affect the trailing waveform would be variations in the threshold voltage Vth (Tr1) thereof. For convenience, the trailing waveform that matches a panel with standard sampling transistor characteristics will hereinafter sometimes be referred to as a standard waveform.

Figure 9:
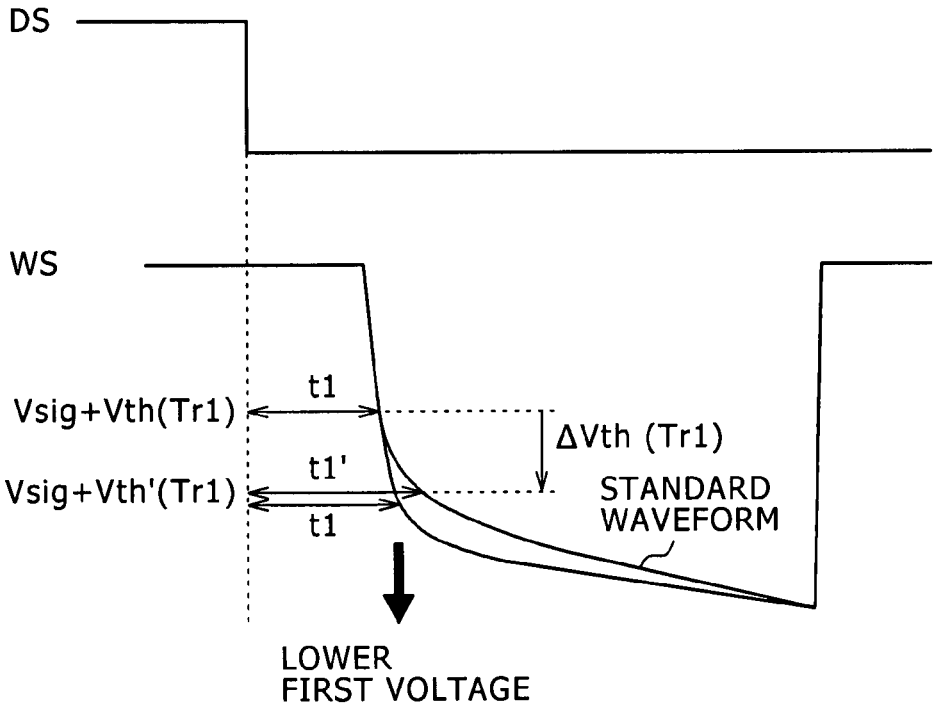
FIG. 9 is a waveform chart that indicates a trailing waveform of a control signal according to an embodiment of the present invention.

The panel with deviated Vth (Tr1) comparing with the standard panel is produced, and a waveform for converting a panel, which is deemed defective in an uneven streak inspection with the standard waveform, into an acceptable product will be described in detail below. FIG. 9 indicates a case where a panel whose Vth (Tr1) is lower than a standard product is produced. With respect to the correction at white scales, the cutoff voltage determined by Vsig+Vth (Tr1) falls below the first voltage for a standard waveform. Therefore, the correction period t is cut off not at point t1 where the trailing waveform drops rapidly, but at point t1' where it drops in a more moderate fashion. As a result, the correction time t1' deviates significantly from the optimum correction time t1 and becomes longer. As a counter measure, with respect to white scales, by using a waveform whose first voltage is lowered below what is standard, the correction time t1 can be set at the rapid point even when Vth (Tr1) is lowered.

Figure 10:
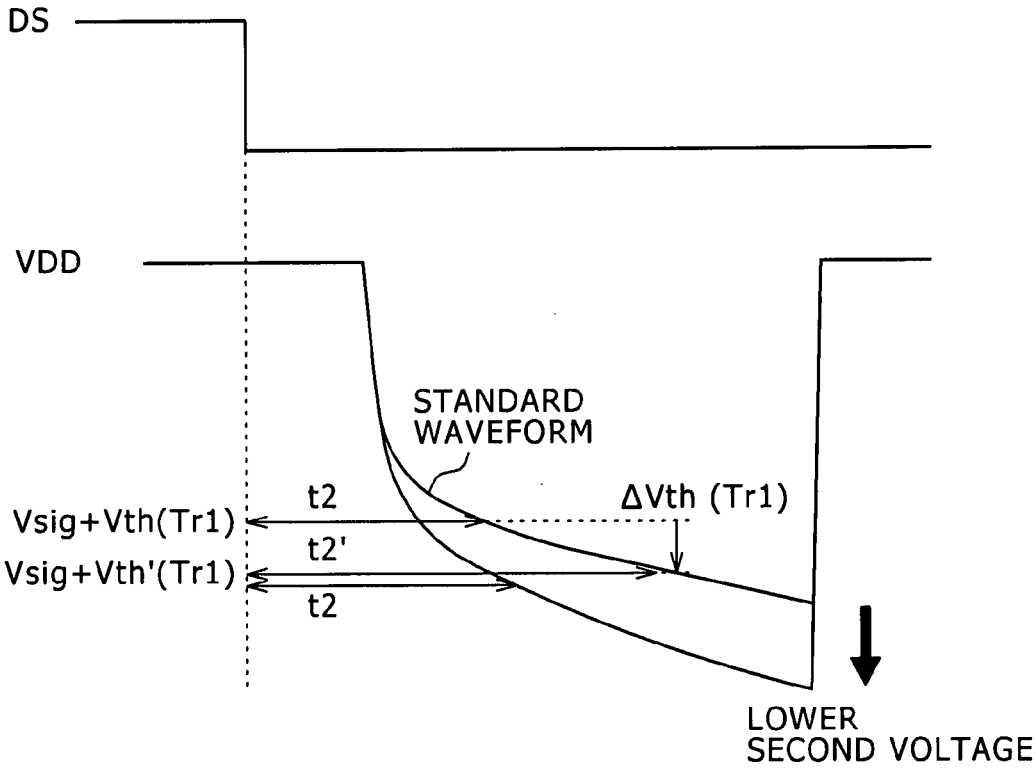
FIG. 10 is also a wave form chart that indicates a trailing waveform.

FIG. 10 also indicates a case where a panel having a Vth' (Tr1) that is lower than the Vth (Tr1) of a standard product is produced, and relates to gray scales. Due to the fact that Vth (Tr1) is lower, the same applies to gray as well, and a correction time t2' becomes longer than the optimum correction period t2. As a counter measure, with respect to gray scales, by lowering the second voltage to below what is standard, the manner in which the trailing is made moderate can be changed a little to make it more rapid, and the correction time can be set to the optimum time t2.

Figure 11:
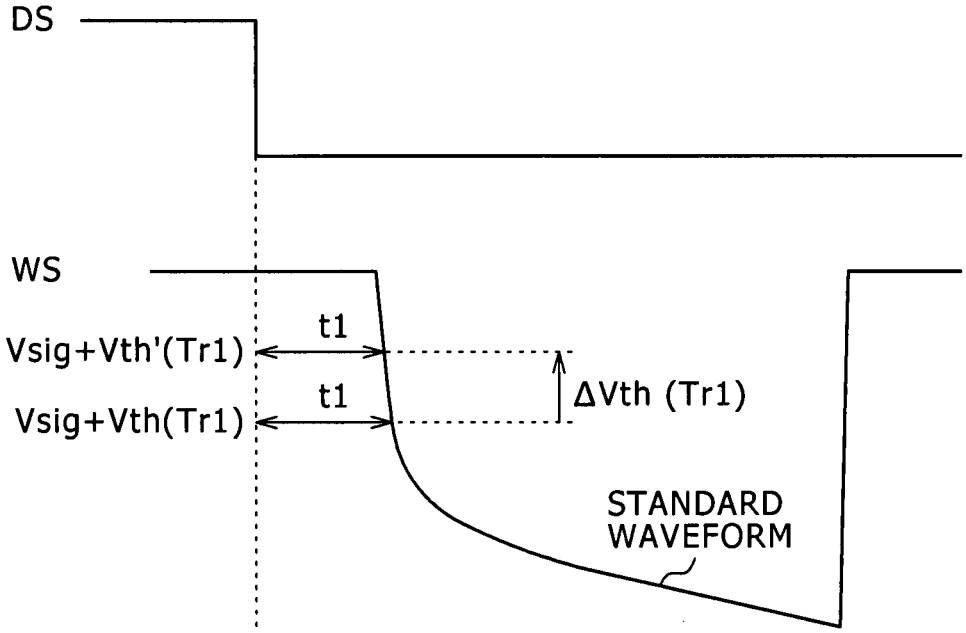
FIG. 11 is also a wave form chart that indicates a trailing waveform.

FIG. 11 indicates a case where a panel having a Vth' (Tr1) that is higher than the Vth (Tr1) of a standard product is produced, and indicates a case where correction for white scales is performed. Since the cut off voltage which is determined by Vsig+Vth' (Tr1) becomes higher than that of a standard product, cut off occurs reliably at the rapid point of the first voltage, and the optimum correction time t1 is maintained even if the first voltage is left unchanged at the standard value.

Figure 12:
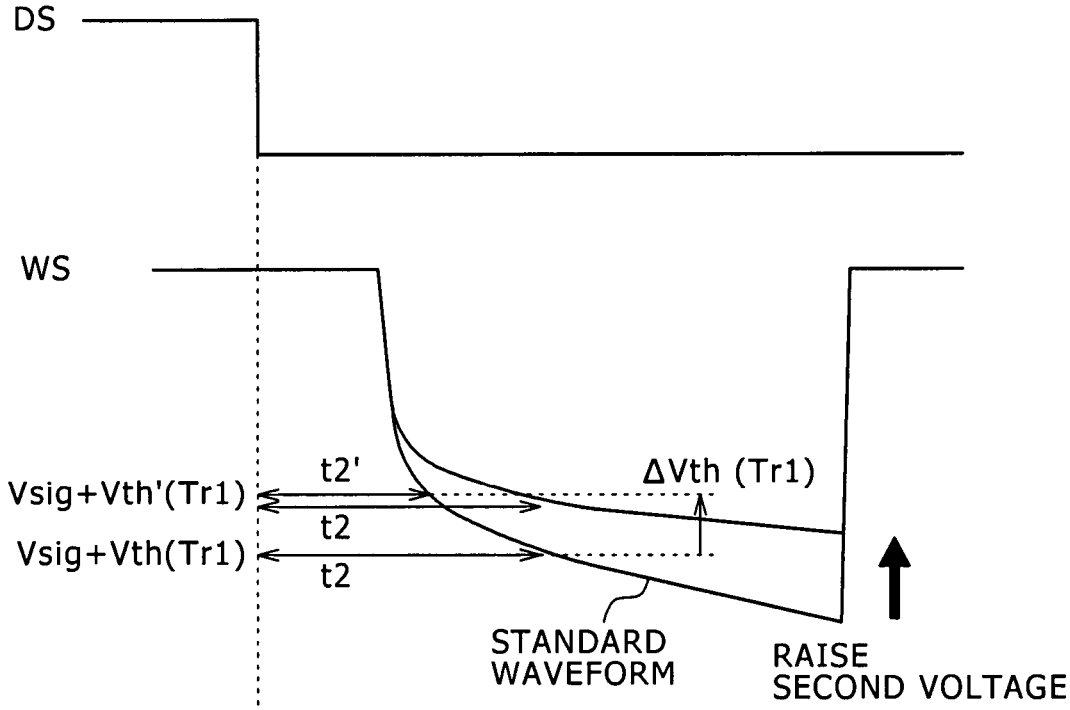
FIG. 12 is also a wave form chart that indicates a trailing waveform.

On the other hand, with respect to gray scales, since the cut off voltage rises as indicated in FIG. 12, a correction time t2' becomes shorter than the optimum value for t2. As a counter measure, by raising the second voltage above that of the standard waveform, the correction time can be set to the optimum value for t2.

Figure 13:
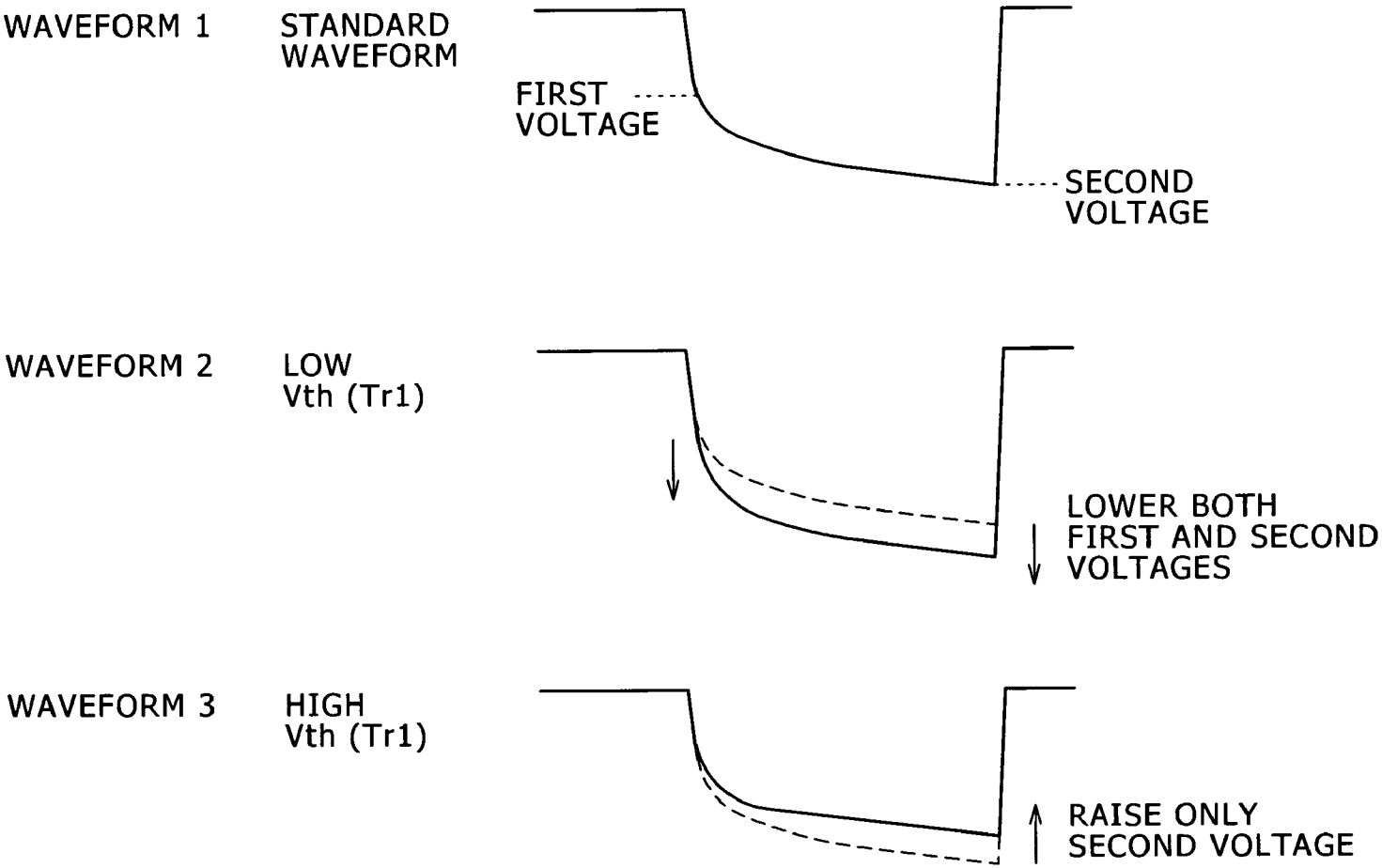
FIG. 13 is also a wave form chart that indicates trailing waveforms.

FIG. 13 is a waveform chart that sums up the results above. Waveform 1 is a standard waveform, waveform 2 is selected when Vth (Tr1) is low, and waveform 3 is selected when Vth (Tr1) is above what is standard. By selecting waveform 2 when Vth (Tr1) is low in relation to the standard value, both the first and second voltages are lowered, and the optimum correction times t1 and t2 can be maintained for both white and gray scales. In addition, by selecting waveform 3 when Vth (Tr1) is above what is standard and thus raising only the second voltage, the optimum correction time t2 can be maintained for gray scales. Thus, when Vth (Tr1) deviates above or below the standard value, by performing inspection while selecting waveform 2 or 3 that suits that particular level, a panel that was deemed defective in terms of uneven streaks using the standard waveform can be converted into an acceptable product, and production yield can be improved.

Figure 14:
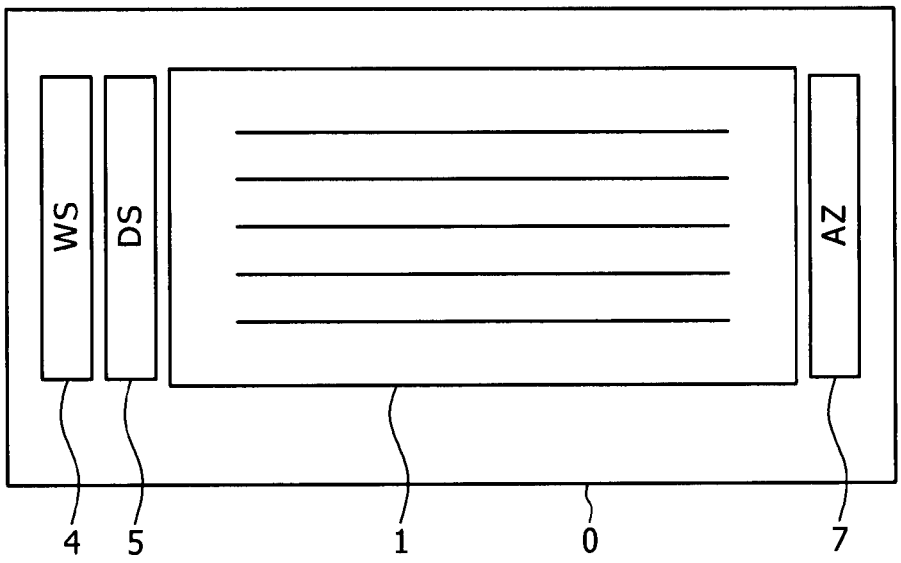
FIG. 14 is a schematic diagram that indicates the overall configuration of an embodiment of a display apparatus according to an embodiment of the present invention.

FIG. 14 is a schematic diagram indicating the overall configuration of a panel according to an embodiment of the present invention. A display apparatus according to the present embodiment includes a panel 0 that is configured with a glass plate and the like. A pixel array section 1 is integrated and formed in the center of this panel 0. In the periphery of the panel 0, there are formed a light scanner 4, a drive scanner 5, a correction scanner 7 and the like which form part of a drive section. It is noted that a horizontal selector is not shown in the diagram, but it can be mounted on the panel 0 in a manner similar to the scanners. Or an external horizontal selector may be provided separately from the panel 0.

Figure 15:
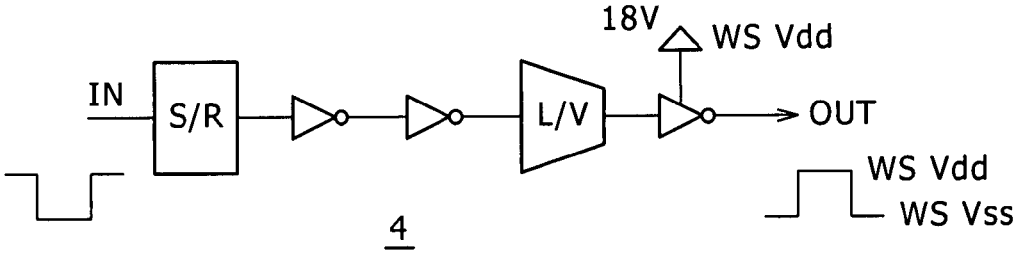
FIG. 15 is a schematic diagram that indicates a reference example of a light scanner included in the panel indicated in FIG. 14.

FIG. 15 is a schematic circuit diagram that indicates one stage of the light scanner 4 shown in FIG. 14. This one stage corresponds to a row of the scanning lines formed in the pixel array section 1. However, the example shown in FIG. 15 is a reference example and not an embodiment, and indicates a case where a rectangular control pulse WS is outputted in the past. As is shown in the diagram, a stage of the light scanner 4 includes a shift register S/R, two interstage buffers, a level shifter L/V, and one output buffer that are connected in series. A power source voltage WSVdd (18V) of the light scanner 4 is supplied to the final output buffer. With this light scanner 4, an input waveform IN that is forwarded from the preceding stage is delayed by the shift register by jusscale stage, is supplied to the level shifter L/V via the interstage buffers, and is converted to a voltage level that is suitable for driving the final output buffer. This output buffer generates an output waveform OUT, which is obtained by inverting the input waveform IN, and supplies it to the corresponding scanning line WS. This output waveform is a rectangular wave, and the high level is WSVdd, while the standard level is WSVss. Since this output waveform OUT has a vertical trailing end, the mobility correction period is a fixed value.

Figure 16:
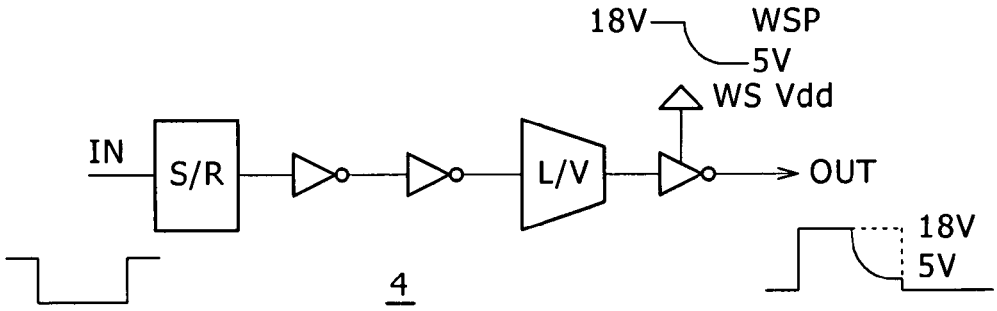
FIG. 16 is also a schematic diagram that indicates an embodiment of the scanner.

FIG. 16 indicates one stage of the write scanner 4 of the present embodiment. In order to facilitate easier understanding, sections that find correspondence to the light scanner of the reference example shown in FIG. 15 are given corresponding reference numerals/symbols. What differs is that in the present embodiment, the power source voltage WSVdd that is supplied to the final output buffer is made to be a pulse waveform that changes from 18V to 5V for example. This power source pulse WSP is supplied to the light scanner 4 of the panel 0 from an external discrete circuit. In so doing, the power source pulse WSP is phase adjusted in advance to make sure it is synchronized with the operations of the light scanner 4.

As shown in the diagram, when the rectangular pulse IN is inputted to the present stage from the preceding stage, it is applied to the gate of the output buffer via the shift register S/R, the two interstage buffers and the level shifter L/V. As a result, the output buffer opens, and the output waveform OUT is supplied to the corresponding scanning line. In so doing, since the power source pulse WSP is applied to the power source voltage line WSVdd after the output buffer turns on, the output waveform falls from 18V towards 5V in a predetermined curve. Then, the output buffer closes, and the output waveform reaches the level of WSVss.

Figure 17:
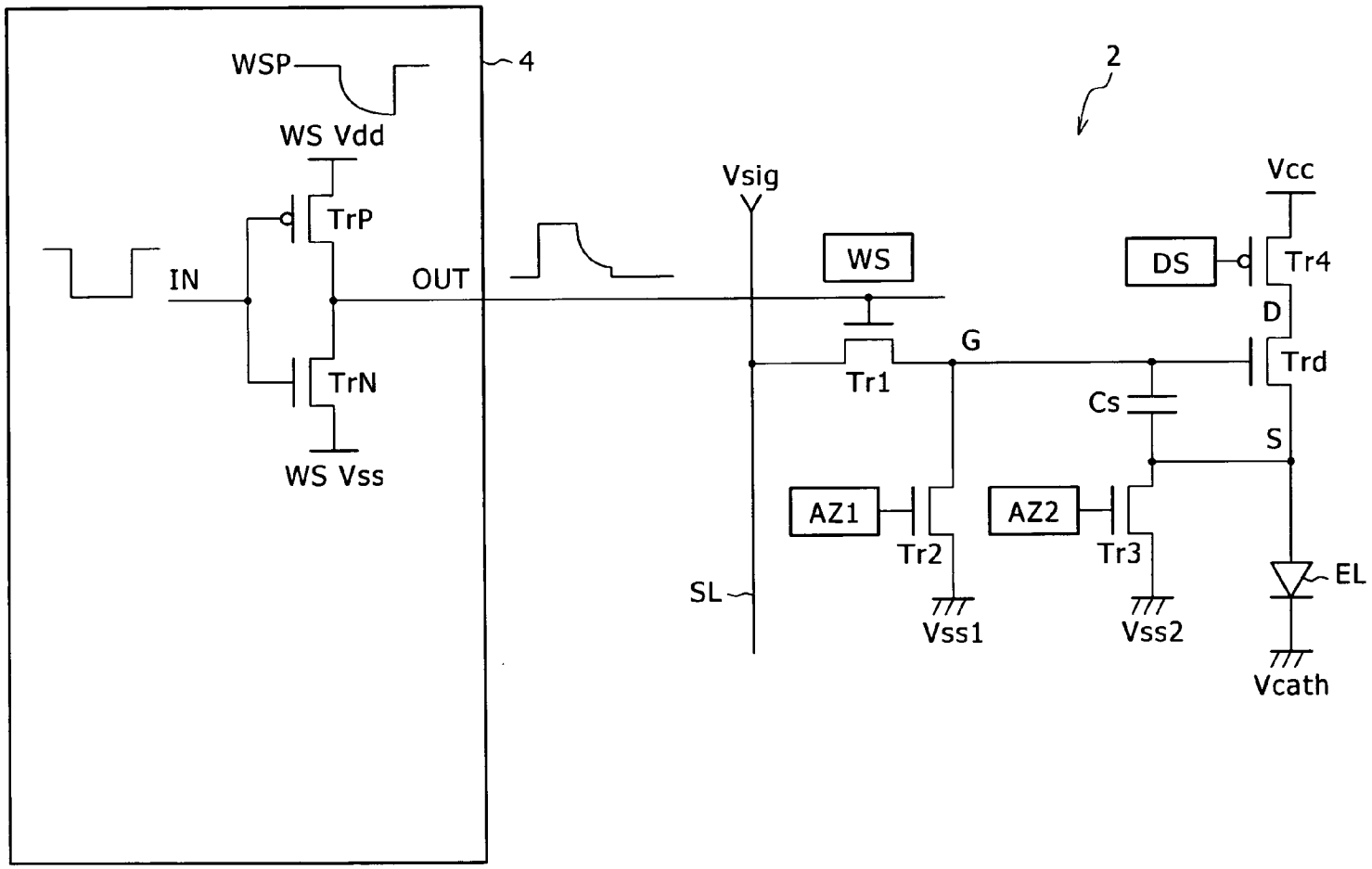
FIG. 17 is a circuit diagram that indicates an output stage of an embodiment of the light scanner.

FIG. 17 is a schematic circuit diagram indicating a configuration example of the final output buffer of the light scanner shown in FIG. 16. As shown in the diagram, this output buffer section includes a pair of P-channel transistor TrP and N-channel transistor TrN, and they are connected in series between a power line WSVdd and an earth line WSVss. The input waveform IN is applied to the gates of both transistors TrP and TrN. A power source pulse WSP which is obtained by phase adjusting this input waveform IN in advance is applied to the power line WSVdd. Once the transistor TrP becomes conductive by means of the application of the input waveform, the trailing waveform of the power source pulse WSP is taken in by the transistor TrP, and is supplied as the output waveform OUT to the scanning line WS on the pixel 2 side. It is noted that, depending on the operation timing, there may be cases where the rising waveform of the power source pulse WSP may pass through the transistor TrP. In such a case, by applying a mask signal to the output stage of the final buffer, the rising on the rear end of the power source pulse WSP can be cut.

Figure 18:
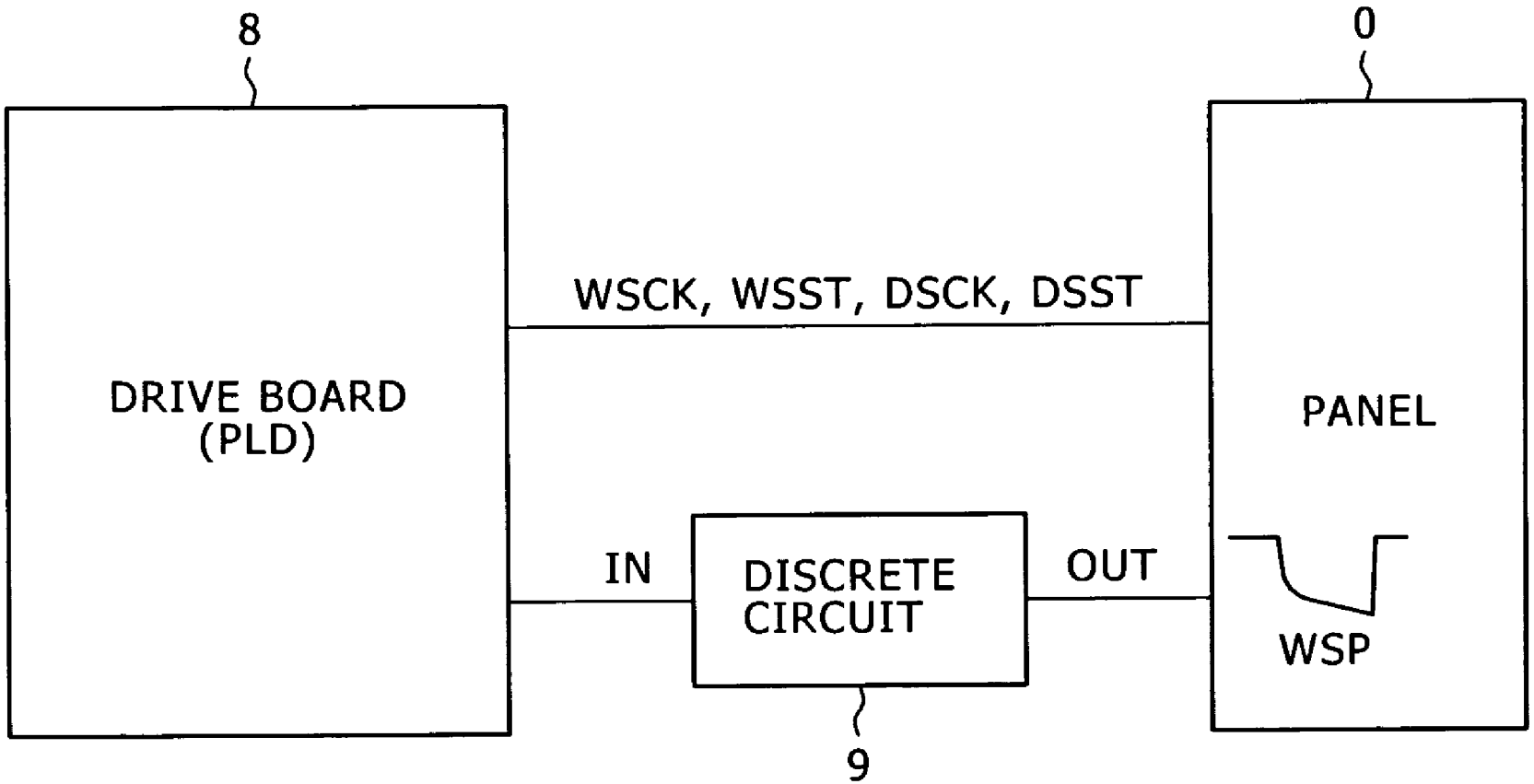
FIG. 18 is a block diagram that indicates the overall configuration of an embodiment.

FIG. 18 is a schematic block diagram indicating the overall configuration of a display apparatus according to an embodiment of the present invention. The panel 0 has the configuration shown in FIG. 14, and includes, besides a pixel array section, various scanners that form part of a drive section. The remaining parts of the drive section, which include an external drive board 8 and a discrete circuit 9, are connected to the panel 0. The drive board 8 includes a PLD, and supplies clock signals WSCK and DSCK, start pulses WSST and DSST and the like, which are necessary for the scanners mounted on the panel 0 to operate. The discrete circuit 9 is inserted between the drive board 8 and the panel 0, and generates necessary power source pulses. More specifically, the discrete circuit 9 receives the input waveform IN from the side of the drive board 8, waveform processes it to generate the output waveform OUT, and supplies it to the panel 0 side. This discrete circuit 9 is configured with such discrete elements as a transistor, resistor, capacitor and the like, and supplies the power source pulse WSP to the power line of the light scanner. The power source pulse WSP is thus generated at the discrete circuit 9, and is inputted to the power line of the light scanner on the side of the panel 0. By generating the power source pulse waveform at the external discrete circuit 9 that is separate from the panel 0, it becomes possible to fine tune the optimum waveform and timing catering to each individual panel 0, thereby contributing to the improvement in yield in the inspection for uneven streaks in the panel 0.

Here, the discrete circuit 9 is capable of selecting the waveform of the power source pulse WSP in accordance with the transistor characteristics of the panel 0 side. In other words, when the threshold voltage of the transistor that is integrated and formed on the panel 0 is lower than what is standard, the discrete circuit 9 selects waveform 2 indicated in FIG. 13 and supplies it to the panel 0 side. On the contrary, when the threshold voltage of the transistor that is integrated and formed on the panel 0 is higher than what is standard, the discrete circuit 9 selects waveform 3 indicated in FIG. 13 and supplies it to the panel 0 side.

As described above, a display apparatus according to an embodiment of the present invention basically includes the pixel array section 1 and the drive section that drives it. The pixel array section 1 is equipped with the first scanning lines WS, the second scanning lines DS, which are arranged in rows, the signal lines SL that are arranged in columns, the pixels 2 arranged in rows and columns which are provided where these lines cross one another, and the power source lines Vcc that supply power to each of the pixels 2, and the earth line. The drive section includes the first scanner 4, which sequentially supplies the first control signal WS to the first scanning lines WS and sequentially line scans the pixels 2 row by row, the second scanner 5 which sequentially supplies the second control signal DS to each of the second scanning lines DS in conjunction with the sequential line scanning mentioned above, and the signal selector 3 which supplies video signals to the columns of signal lines SL in conjunction with the sequential line scanning mentioned above. The pixels 2 include the light emitting element EL, the sampling transistor Tr1, the drive transistor Trd, the switching transistor Tr4, and the pixel capacitance Cs. The sampling transistor Tr1 has its gate connected with the first scanning line WS, its source connected with the signal line SL, and its drain connected with the gate G of the drive transistor Trd. The drive transistor Trd and the light emitting element EL are connected in series between the power source line Vcc and the earth line, thereby forming a current path. The switching transistor Tr4 is inserted in this current path, while its gate is connected to the second scanning line DS. The pixel capacitance Cs is connected between the source S and the gate G of the drive transistor Trd.

With this configuration, the sampling transistor Tr1 turns on in accordance with the first control signal WS supplied from the first scanning line WS, samples the signal potential Vsig of the video signal supplied from the signal line SL and holds it in the pixel capacitance Cs. The switching transistor Tr4 turns on in accordance with the second control signal DS supplied from the second scanning line DS and places the current path in a conductive state. In accordance with the signal potential Vsig held by the pixel capacitance Cs, the drive transistor Trd lets the drive current Ids flow to the light emitting element EL via the current path that is placed in a conductive state.

After the first control signal WS is applied to the first scanning line WS to turn on the sampling transistor Tr1 and the sampling of the signal potential Vsig is begun, the drive section, which includes the light scanner 4 and the drive scanner 5, during the correction period t from the first timing T6, at which the switching transistor Tr4 turns on as the second control signal DS is applied to the second scanning line DS, up to the second timing T7, at which the sampling transistor Tr1 turns off as the first control signal WS applied to the first scanning line WS is terminated, applies to the signal potential Vsig held by the pixel capacitance Cs the correction with respect to the mobility μ of the drive transistor Trd. In so doing, when turning off the sampling transistor Tr1 at the second timing T7, by giving a gradient to the trailing waveform of the first control signal WS, the first scanner 4 automatically adjusts the second timing T7 in such a manner that the correction period t becomes shorter when the signal potential Vsig is high while the correction period t becomes longer when the signal potential Vsig is low. The first scanner 4 selectively uses a plurality of trailing waveforms in accordance with the level of the threshold voltage Vth (Tr1) of the sampling transistor Tr1. More specifically, when the threshold voltage Vth (Tr1) of the sampling transistor Tr1 is of a standard level, the first scanner 4 uses a standard trailing waveform (waveform 1) where the gradient is initially steep down to the first potential and is then more gentle towards the second potential. When the threshold voltage Vth (Trp) of the sampling transistor Tr1 is lower than the standard level, the first scanner 4 uses a trailing waveform (waveform 2) where both the first potential and the second potential are lower as compared to the standard waveform (waveform 1). When the threshold voltage Vth (Tr1) of the sampling transistor Tr1 is higher than the standard level, the first scanner 4 uses a trailing waveform (waveform 3) where only the second potential is higher as compared to the standard waveform (waveform 1).

It is noted that each of the pixels 2 includes the additional switching transistors Tr2 and Tr3 for resetting the gate potential (G) and the source potential (S) of the drive transistor Trd prior to the sampling of the video signal. The second scanner 5 temporarily turns on the switching transistor Tr4 via the second control line DS prior to the sampling of the video signal, and allows the drive current Ids to flow through the drive transistor Trd, which has thus been reset, thereby having a voltage corresponding to the threshold voltage thereof be held by the pixel capacitance Cs.

Figure 19:
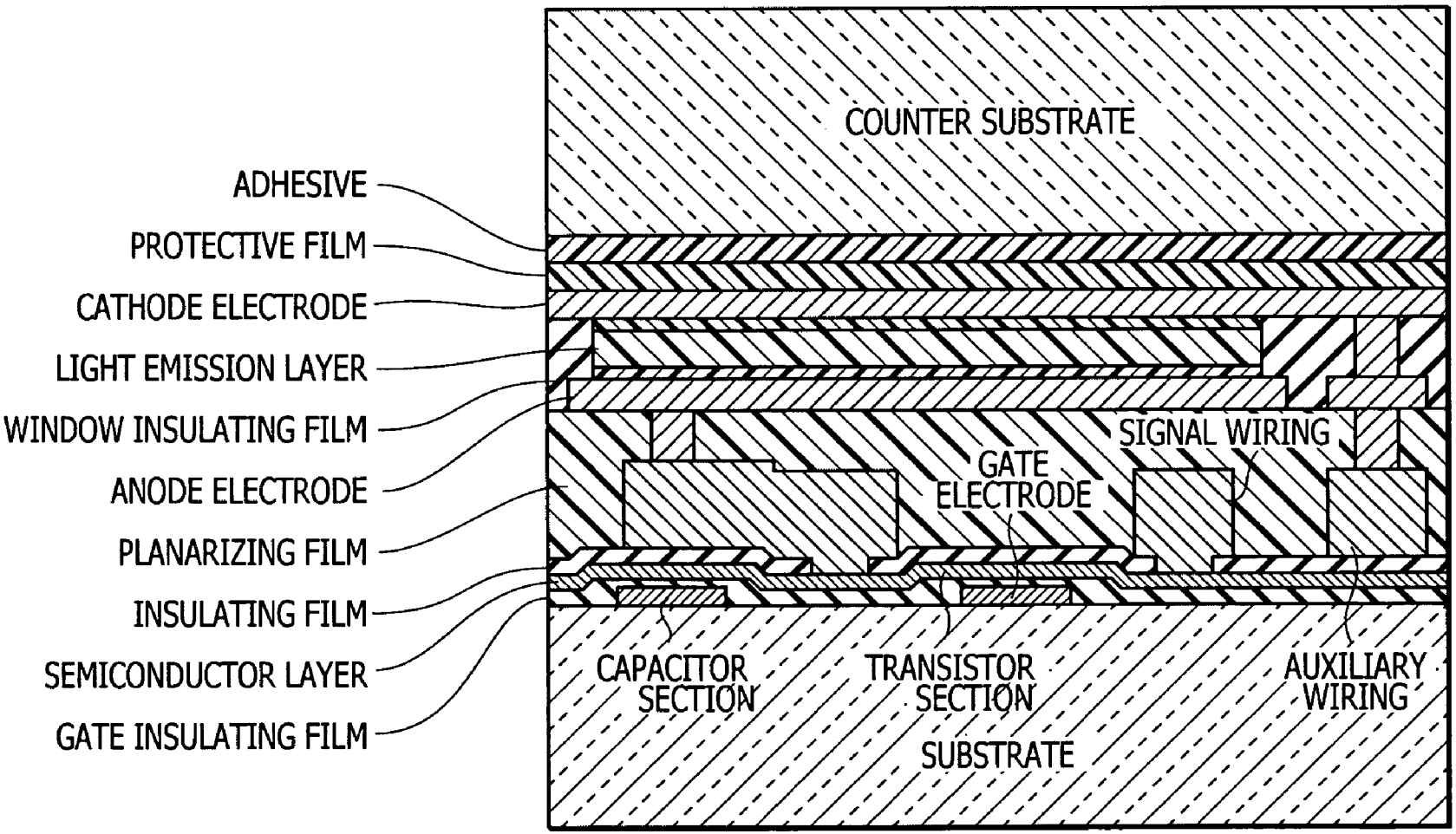
FIG. 19 is a sectional view indicating the device configuration of a display apparatus according to an embodiment of the present invention.

A display apparatus according to an embodiment of the present invention may have such a thin film device configuration as the one shown in FIG. 19. FIG. 19 indicates a schematic sectional structure of a pixel that is formed on an insulative substrate. As shown in the diagram, the pixel includes a transistor section that includes a plurality of thin film transistors (in the diagram, one TFT is shown as an example), a capacitance section such as a retentive capacitance and the like, and a light emitting section such as an organic EL element and the like. The transistor section and the capacitance section are formed on the substrate by a TFT process, and the light emitting section, such as an organic EL element, is laid thereon. A transparent counter substrate is adhered thereon via an adhesive, and a flat panel is thereby obtained.

Figure 20:
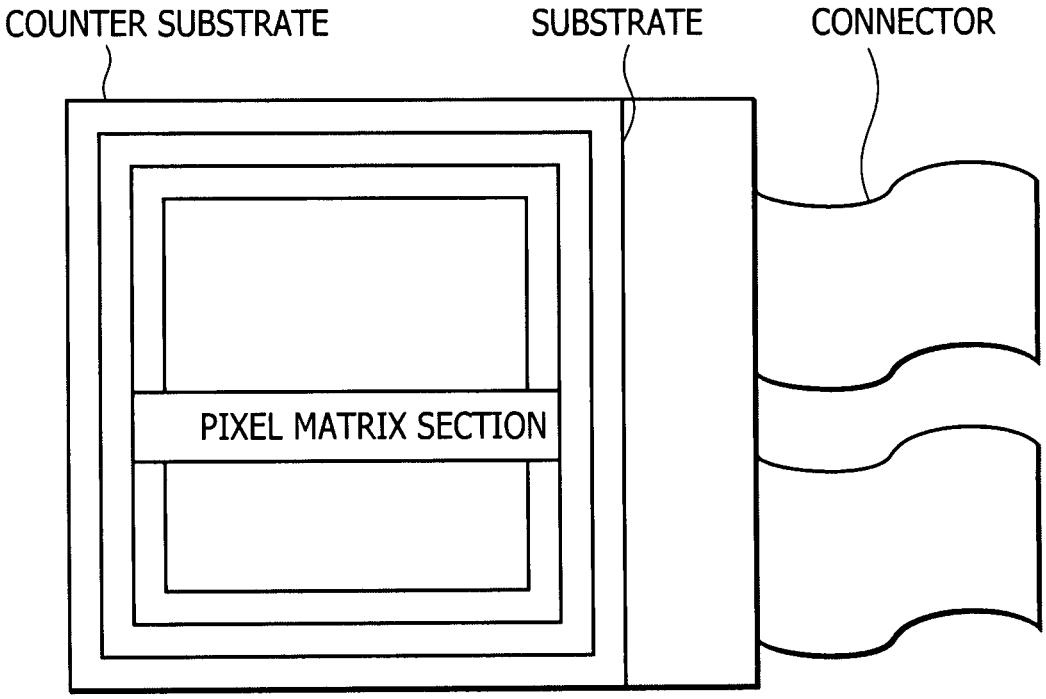
FIG. 20 is a plan view indicating the module configuration of a display apparatus according to an embodiment of the present invention.

A display apparatus according to an embodiment of the present invention includes a flat module type as shown in FIG. 20. For example, on an insulative substrate, a pixel array section in which pixels, each of which include an organic EL element, a thin film transistor, a thin film capacitance and the like, are integrated and formed in a matrix is provided. An adhesive is provided in such a manner that it surrounds this pixel array section (or pixel matrix section), a counter substrate of glass or the like is adhered, and a display module is thus obtained. This transparent counter substrate may be provided with a colour filter, a protective film, a light blocking film and the like as deemed necessary. The display module may be provided with, for example, an FPC (Flexible Print Circuit) as a connector for inputting and outputting signals from an external source to the pixel array section.

The display apparatus according to an embodiment of the present invention described above has a flat panel shape, and may be applied to the display of a variety of electronic devices, such as digital cameras, laptop personal computers, mobile phones, video cameras and the like, which display video signals that are inputted thereto or generated therein as images or as video. Below, examples of electronic devices to which such a display apparatus is applied are described.

Figure 21:
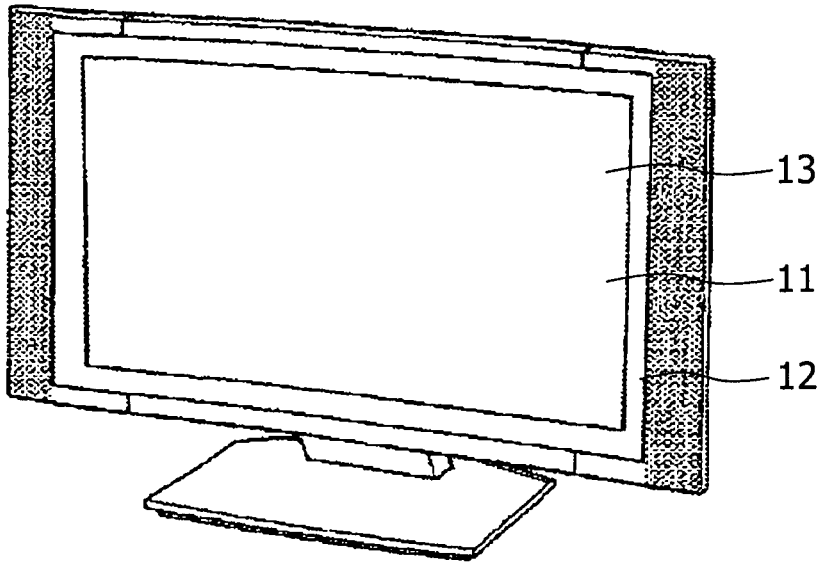
FIG. 21 is a perspective view indicating a television set equipped with a display apparatus according to an embodiment of the present invention.

FIG. 21 shows a television set to which the present embodiment is applied, and includes an image display screen 11 that includes a front panel 12, a filter glass 13 and the like. It is produced by using a display apparatus of the present embodiment for its image display screen 11.

Figure 22:
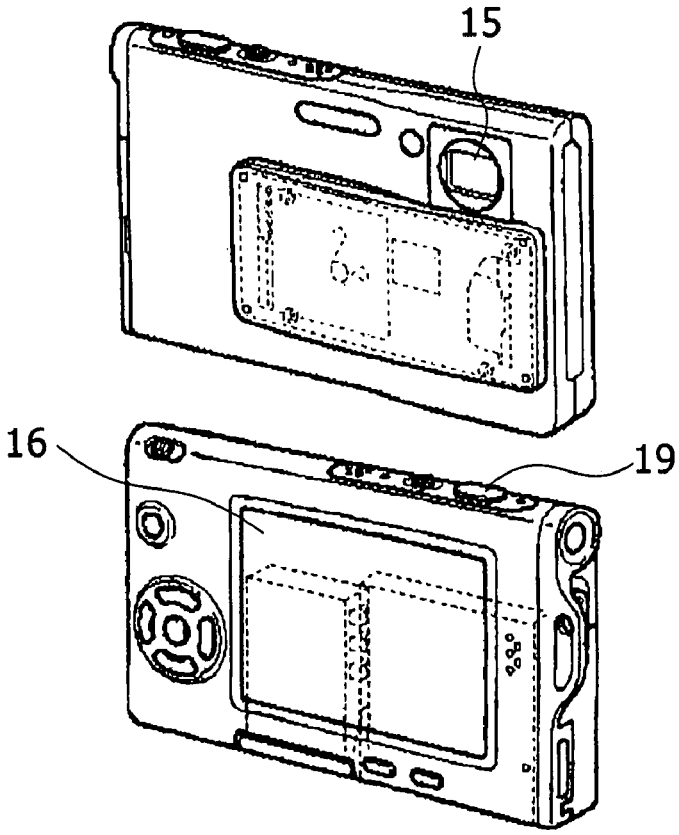
FIG. 22 is a perspective view indicating a digital still camera equipped with a display apparatus according to an embodiment of the present invention.

FIG. 22 shows a digital camera to which an embodiment of the present invention is applied, and the one on top is a front view and the one below is a rear view. This digital camera includes an imaging lens, a flash light emitting section 15, a display section 16, a control switch, a menu switch, a shutter 19 and the like, and is produced by using the display apparatus of the present embodiment for its display section 16.

Figure 23:
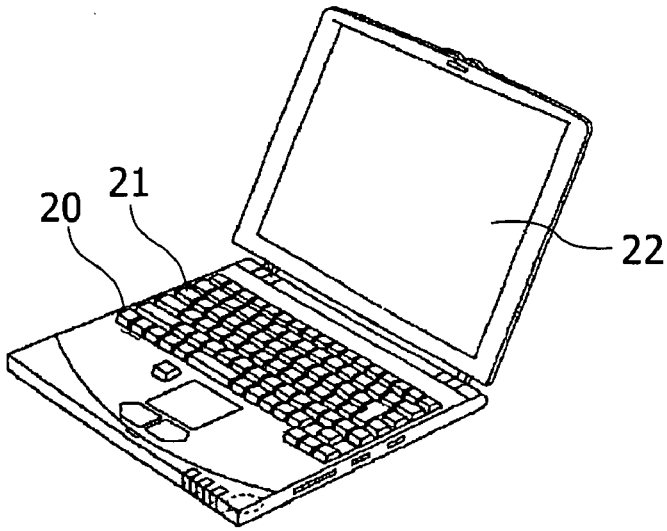
FIG. 23 is a perspective view indicating a laptop personal computer equipped with a display apparatus according to an embodiment of the present invention.

FIG. 23 shows a laptop personal computer to which an embodiment of the present invention is applied. A main body 20 includes a keyboard 21 that is operated to input text and the like, a main body cover includes a display section 22 for displaying images and the like, and this personal computer is produced by using a display apparatus of the present embodiment for its display section 22.

Figure 24:
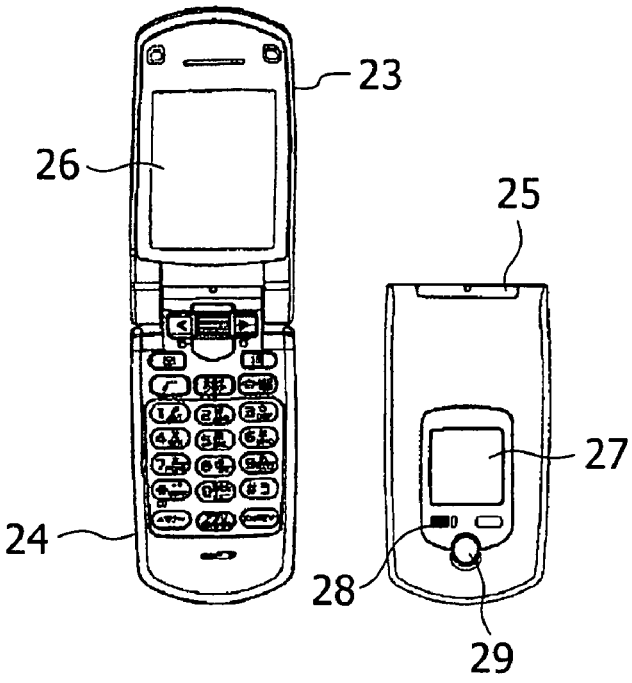
FIG. 24 is a schematic diagram indicating a portable terminal apparatus equipped with a display apparatus according to an embodiment of the present invention.

FIG. 24 shows a portable terminal apparatus to which an embodiment of the present invention is applied, and an opened state is shown on the left, while a closed state is shown on the right. This portable terminal apparatus includes an upper chassis 23, a lower chassis 24, a joint section (a hinge section in this case) 25, a display 26, a sub-display 27, a picture light 28, a camera 29 and the like, and is produced by using a display apparatus of the present embodiment for its display 26 and/or its sub-display 27.

Figure 25:
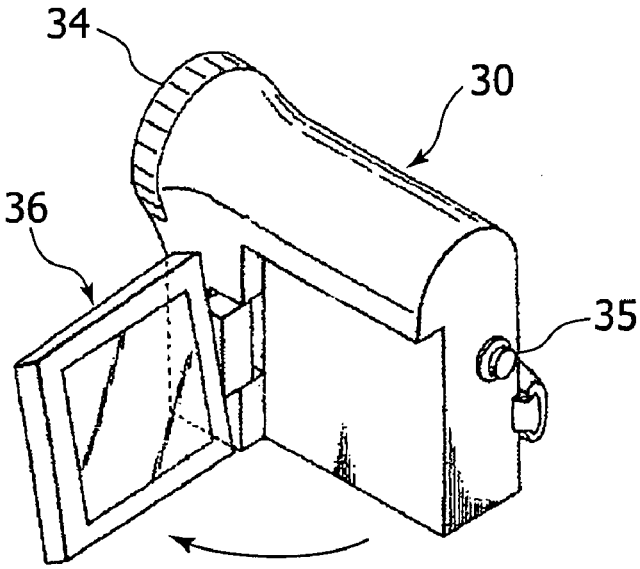
FIG. 25 is a perspective view indicating a video camera equipped with a display apparatus according to an embodiment of the present invention.

FIG. 25 shows a video camera to which the present embodiment is applied. This video camera includes a main body section 30, a subject shooting lens 34 which faces forward, a start/stop switch 35 for shooting, a monitor 36 and the like, and is produced by using a display apparatus of the present embodiment for its monitor 36.

The present document contains subject matter related to Japanese Patent Application No. 2006-196875 filed in the Japanese Patent Office on Jul. 19, 2006, the entire content of which being incorporated herein by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A display apparatus, comprising:

a pixel array section; and a drive section that drives the pixel array section, wherein the pixel array section includes first scanning lines and second scanning lines arranged in rows, signals lines arranged in columns, pixels that are provided where the first scanning lines, the second scanning lines, and the signal lines meet and that are arranged in rows and columns, a power line that supplies power to each of the pixels, and an earth line, the drive section includes a first scanner that sequentially line scans the pixels in rows by sequentially supplying a first control signal to each of the first scanning lines, a second scanner that sequentially supplies a second control signal to each of the second scanning lines in conjunction with the sequential line scanning, and a signal selector that supplies a video signal to the columns of signal lines in conjunction with the sequential line scanning, each of the pixels includes a light emitting element, a sampling transistor, a drive transistor, a switching transistor and a pixel capacitance, the sampling transistor has its gate connected with the first scanning line, its source connected with the signal line, and its drain connected with a gate of the drive transistor, the drive transistor and the light emitting element form a current path by being connected in series between the power line and the earth line, the switching transistor is inserted in the current path and its gate is connected with the second scanning line, the pixel capacitance is connected between a source and the gate of the drive transistor, the sampling transistor turns on in response to the first control signal supplied from the first scanning line, and samples a signal potential of the video signal supplied from the signal line and holds it in the pixel capacitance, the switching transistor turns on in response to the second control signal supplied from the second scanning line and turns the current path in a conductive state, the drive transistor allows a drive current corresponding to the signal potential held in the pixel capacitance to flow through the light emitting element via the current path that is turned in the conductive state, after starting the sampling of the signal potential by turning on the sampling transistor by applying the first control signal to the first scanning line, the drive section applies to the signal potential held by the pixel capacitance a correction with respect to a mobility of the drive transistor during a correction period, the correction period being a time period from a first timing at which the switching transistor turns on by having the second control signal applied to the second scanning line up to a second timing at which the sampling transistor turns off when the first control signal applied to the first scanning line is terminated, in turning off the sampling transistor at the second timing, the first scanner gives a gradient to a trailing waveform of the first control signal, and thereby automatically adjusts the second timing in such a manner that when the signal potential is high, the correction period becomes shorter, while when the signal potential is low, the correction period becomes longer, and a plurality of trailing waveforms are selectively used in accordance with the level of the threshold voltage of the sampling transistor.

2. The display apparatus according to claim 1 wherein, the first scanner uses a standard trailing waveform, where the gradient is initially steep down to a first potential and then made more gentle towards a second potential, when the threshold voltage of the sampling transistor is of a standard level, uses a trailing waveform, where both the first potential and the second potential are lower compared to the standard trailing waveform, when the threshold voltage of the sampling transistor is lower than the standard level, and uses a trailing waveform, where only the second potential is higher compared to the standard trailing waveform, when the threshold voltage of the sampling transistor is higher than that of the standard level.

3. The display apparatus according to claim 1, wherein each of the pixels includes an additional switching transistor that resets, prior to the sampling of the video signal, a gate potential and source potential of the drive transistor, and the second scanner temporarily turns on, prior to the sampling of the video signal, the switching transistor via the second scanning line, allows the drive current to flow to the drive transistor that is thus reset, and holds a voltage corresponding to a threshold voltage of the drive transistor in the pixel capacitance.

4. An electronic device comprising the display apparatus claimed in claim 1.

5. The electronic device according to claim 4 wherein, the first scanner uses a standard trailing waveform, where the gradient is initially steep down to a first potential and then made more gentle towards a second potential, when the threshold voltage of the sampling transistor is of a standard level, uses a trailing waveform, where both the first potential and the second potential are lower compared to the standard trailing waveform, when the threshold voltage of the sampling transistor is lower than the standard level, and uses a trailing waveform, where only the second potential is higher compared to the standard trailing waveform, when the threshold voltage of the sampling transistor is higher than that of the standard level.

6. The electronic device according to claim 4, wherein each of the pixels includes an additional switching transistor that resets, prior to the sampling of the video signal, a gate potential and source potential of the drive transistor, and the second scanner temporarily turns on, prior to the sampling of the video signal, the switching transistor via the second scanning line, allows the drive current to flow to the drive transistor that is thus reset, and holds a voltage corresponding to a threshold voltage of the drive transistor in the pixel capacitance.

7. A driving method for a display apparatus, the display apparatus comprising:

a pixel array section; and a drive section that drives the pixel array section, wherein the pixel array section includes first scanning lines and second scanning lines arranged in rows, signals lines arranged in columns, pixels that are provided where the first scanning lines, the second scanning lines, and the signal lines meet and that are arranged in rows and columns, a power line that supplies power to each of the pixels, and an earth line, the drive section includes a first scanner that sequentially line scans the pixels in rows by sequentially supplying a first control signal to each of the first scanning lines, a second scanner that sequentially supplies a second control signal to each of the second scanning lines in conjunction with the sequential line scanning, and a signal selector that supplies video signals to the columns of signal lines in conjunction with the sequential line scanning, each of the pixels includes a light emitting element, a sampling transistor, a drive transistor, a switching transistor and a pixel capacitance, the sampling transistor has its gate connected to the first scanning line, its source connected to the signal line, and its drain connected to a gate of the drive transistor, the drive transistor and the light emitting element form a current path by being connected in series between the power line and the earth line, the switching transistor is inserted in the current path and its gate is connected to the second scanning line, the pixel capacitance is connected between a source and the gate of the drive transistor, the sampling transistor turns on in response to the first control signal supplied from the first scanning line, and samples a signal potential of the video signal supplied from the signal line and holds it in the pixel capacitance, the switching transistor turns on in response to the second control signal supplied from the second scanning line and turns the current path in a conductive state, the drive transistor allows a drive current corresponding to the signal potential held in the pixel capacitance to flow to the light emitting element via the current path that is placed in the conductive state, after starting the sampling of the signal potential by turning on the sampling transistor by applying the first control signal to the first scanning line, the drive section applies to the signal potential held by the pixel capacitance a correction with respect to a mobility of the drive transistor during a correction period, the correction period being a time period from a first timing at which the switching transistor turns on by having the second control signal applied to the second scanning line up to a second timing at which the sampling transistor turns off when the first control signal applied to the first scanning line is terminated, in turning off the sampling transistor at the second timing, the first scanner gives a gradient to a trailing waveform of the first control signal, and thereby automatically adjusts the second timing in such a manner that when the signal potential is high, the correction period becomes shorter, while when the signal potential is low, the correction period becomes longer, and a plurality of trailing waveforms are selectively used in accordance with the level of the threshold voltage of the sampling transistor.

8. The driving method according to claim 7 wherein, the first scanner uses a standard trailing waveform, where the gradient is initially steep down to a first potential and then made more gentle towards a second potential, when the threshold voltage of the sampling transistor is of a standard level, uses a trailing waveform, where both the first potential and the second potential are lower compared to the standard trailing waveform, when the threshold voltage of the sampling transistor is lower than the standard level, and uses a trailing waveform, where only the second potential is higher compared to the standard trailing waveform, when the threshold voltage of the sampling transistor is higher than that of the standard level.

9. The driving method according to claim 7, wherein each of the pixels includes an additional switching transistor that resets, prior to the sampling of the video signal, a gate potential and source potential of the drive transistor, and the second scanner temporarily turns on, prior to the sampling of the video signal, the switching transistor via the second scanning line, allows the drive current to flow to the drive transistor that is thus reset, and holds a voltage corresponding to a threshold voltage of the drive transistor in the pixel capacitance.

* * * * *